US005889539A

United States Patent [19]

Kamoi et al.

[11] Patent Number: 5,889,539

[45] Date of Patent: Mar. 30, 1999

[54] INK JET PRINT HEAD

[75] Inventors: Kazumi Kamoi; Minoru Usui; Takahiro Katakura; Satoshi Shinada; Kouichi Toba, all of Nagano, Japan

[73] Assignee: Seiko Epson Corporation, Tokyo, Japan

[21] Appl. No.: 686,527

[22] Filed: Jul. 26, 1996

[30] Foreign Application Priority Data

| | | | |
|---|---|---|---|
| Jul. 26, 1995 | [JP] | Japan | 7-209927 |
| Aug. 30, 1995 | [JP] | Japan | 7-245308 |
| Jul. 5, 1996 | [JP] | Japan | 8-195625 |

[51] Int. Cl.[6] ..... B41J 2/045

[52] U.S. Cl. ..... 347/50; 347/70; 347/71

[58] Field of Search ..... 347/50, 68, 70, 347/71, 72; 361/760, 774, 765

[56] References Cited

U.S. PATENT DOCUMENTS 4,695,854 9/1987 Cruz-Uribe ..... 347/40

FOREIGN PATENT DOCUMENTS 0 519 403 12/1992 European Pat. Off. ..... B41J 2/14

0 538 021 4/1993 European Pat. Off. ..... H01R 13/24

OTHER PUBLICATIONS

Patent Abstracts of Japan, vol. 015, No. 416 (M–1172), Oct. 23, 1991; & JP 03 175044 A (Ricoh Co Ltd) Jul., 30 1991 *Abstract.

Patent Abstracts of Japan, vol. 095, No. 009, Oct. 31, 1995, & JP 07 144406 A (Canon Inc), Jun. 6, 1995 *Abstract.

*Primary Examiner*—N. Le
*Assistant Examiner*—Anh T. N. Vo
*Attorney, Agent, or Firm*—Sughrue, Mion, Zinn, Macpeak & Seas, PLLC

[57] ABSTRACT

An ink jet print head includes first terminals 22 and 22', which are located at the side ends of a cover member 2 as a vibrating plate, and are connected to discrete electrodes 6 and 6' for selectively applying signals to piezoelectric vibrators 5 and 5'. A semiconductor integrated circuit 30 includes second terminals 31 and 31' that are arrayed corresponding in position to the first terminals 22 and 22' and generates a drive signal in response to an external signal. The first terminals 22 and 22' are connected to the second terminals 31 and 31' such that a gap of H in height is formed between the semiconductor integrated circuit 30 and the piezoelectric vibrators 5 and 5'.

27 Claims, 21 Drawing Sheets

INK JET PRINT HEAD

BACKGROUND OF THE INVENTION

The present invention relates to an ink jet print head of the type in which a nozzle plate, a fluid path forming member and an elastically deformable cover member are layered, and pressure generating means are attached to the cover member.

An ink jet print head of the type in which a nozzle plate, a fluid path forming member and an elastically deformable cover member are layered, and pressure generating means, for example, piezoelectric vibrators of a flexure vibration mode, are attached to the surface of the cover member, is known. In the print head, most of the members or constituent elements of the print head are made of ceramics. Accordingly, it is possible to layer the green sheets of those elements and to sinter the layered ones. In other words, these elements may be jointed together without adhesive, and hence there is eliminated a bonding step by adhesive in the manufacturing process of the print head, and the manufacturing process is simplified.

In the print head, as shown in FIG. 32(*a*), discrete electrodes B, B, . . . , B of piezoelectric vibrators A, A, . . . , A are connected to an external device by a flexible cable C.

To improve the print quality and the printing speed, some type of the print head has an increased number of nozzle holes. In this type of the print head, the discrete electrodes are extremely narrow in width, and the number of them is large. Connection work of these discrete electrodes to a flexible cable C is very difficult. Further, the conductive patterns of the flexible cable C as signal paths connecting an external device to the print head are also considerably narrow. The narrow conductive patterns have high electrical resistance. To feed signals of satisfactorily high level from the external device to the print head through the conductive patterns, a drive circuit of high drive voltage and high power is required.

To solve the problem, there is a proposal as shown in FIG. 32(*b*). In the proposal, a semiconductor chip D with a drive signal generating function is fastened to the surface of an actuator unit E of the print head and sealed by resin F. The semiconductor chip D must be mounted at a place on the actuator unit E where no piezoelectric vibrators are present. This increases the size of the print head, and requires additional work to connect the signal output terminals of the semiconductor chip D to the discrete electrodes B, B, . . . , B by wires G and G'.

The flexible cable that connects electric signals from the external device to the print head is mounted on the actuator unit in such a way that the cable extends over the arrays of piezoelectric vibrators on the rear side of the actuator unit, and are secured at both the ends in width direction to the terminals connecting to the discrete electrodes on both sides of the actuator unit. Such a mounting of the flexible cable creates some problems. For example, in the case of the loosely mounted flexible cable, if an external force acts on the flexible cable, the flexible cable will come in contact with the piezoelectric vibrators. In this state, the cable suppressively acts on the vibration of the piezoelectric vibrators.

SUMMARY OF THE INVENTION

The present invention has been made in view of the above circumstances and has a first object to provide a novel ink jet print head which simplifies the wiring structure to connect the print head with an external drive circuit without increasing the size of the print head.

Another object of the present invention is to provide a novel ink jet print head which reliably prevents the flexible cable from coming into contact with the piezoelectric vibrators, and easily joints the flexible cable with the actuator unit.

To achieve the objects, the present invention provides an ink jet print head comprising: a first cover member; a spacer attached to the first cover to seal at one side thereof to partially define pressure generating chambers; a member having nozzle openings for sealing the other side of the spacer, the nozzle openings being communicated with the respective pressure generating chambers; pressure generating means for applying pressure to the pressure generating chambers; first terminals formed at the side ends of the first cover member and connected to discrete electrodes for selectively applying signals to the pressure generating means; and drive signal generating means for generating a drive signal to drive the pressure generating means in response to an external signal received, the drive signal generating means having second terminals arrayed at the same pitches as the first terminals, wherein the first terminals are directly connected to the respective second terminals of the drive signal generating means in a state that a gap is present between the drive signal generating means and the pressure generating means.

In the print head thus arranged, the first cover member and the drive signal generating means are vertically arrayed. Accordingly, any additional area is not required for providing the drive signal generating means. Further, the first terminals are directly connected to the second terminals of the drive signal generating means by conductive junction means. Accordingly, there is eliminated the connection and soldering work using wires.

BRIEF DESCRIPTION OF THE DRAWINGS

FIG. 1(*b*) is a cross sectional view showing an instance of the connection structure of the print head to an external device;

DETAILED DESCRIPTION OF THE PREFERRED EMBODIMENTS

The preferred embodiments of the present invention will be described with reference to the accompanying drawings.

Figure 1A:
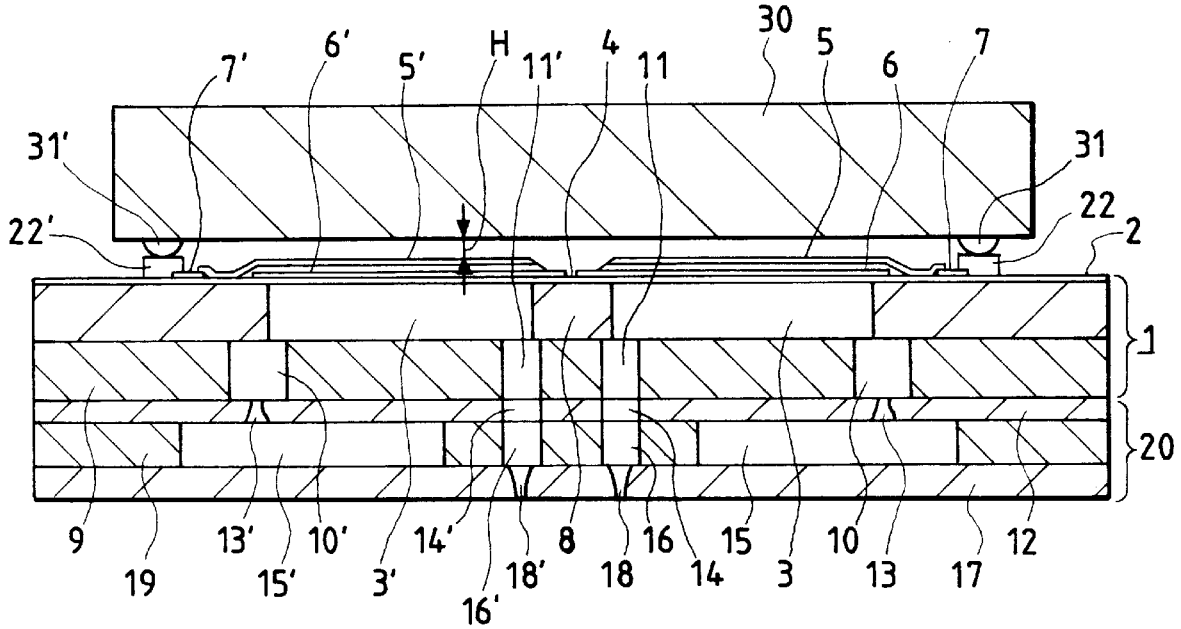
FIG. 1(*a*) is a cross sectional view showing an embodiment of an ink jet print head according the present invention.
Figure 1B:
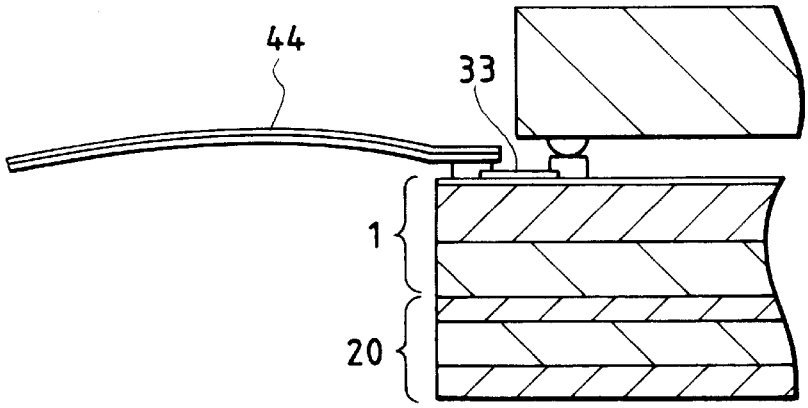

FIG. 1 is a diagram showing an embodiment of an ink jet print head according to the present invention. In the figure, there is illustrated the structure in the vicinity of the pressure generating chambers of one actuator unit of the print head. Reference numeral 2 designates a first cover member as a zirconium thin plate of 10 $\mu$m thick. A common electrode 4, which serves as one of the poles, is formed on the surface of the first cover member 2 in a state that it is located facing pressure generating chambers 3 and 3'. Piezoelectric vibrators 5 and 5', which comprise thin plates made of piezoelectric material, e.g., PZT, are fastened to the common electrode 4.

Discrete electrodes 6 and 6' are formed on the surfaces of the piezoelectric vibrators 5 and 5', respectively. Conductive patterns 7 and 7' as lead paths, made of conductive material, are formed by evaporation process so as to correspond to the common electrode 4. The conductive patterns 7 and 7' extend to the side ends of the first cover member 2.

A spacer 8 is formed of a ceramic plate with holes formed therein. The ceramic plate is made of zirconia ($ZrO_2$) having a thickness, e.g., 150 $\mu$m, suitable for the formation of the pressure generating chambers 3 and 3'. The first cover member 2 and a second cover member 9 to be described later are applied to the top and bottom of the spacer 8, and seals the spacer. The holes of the spacer 8 thus sealed serve as pressure generating chambers 3 and 3'.

The second cover member 9 is a thin ceramic plate with holes formed therein, made of zirconia, for example. These holes are through-holes 10 and 10' and through-holes 11 and 11'. The through-hole 10, 10' communicatively connects an ink supplying port 13, 13' to be described later to the pressure generating chamber 3, 3', respectively. The through-holes 11, 11' communicatively connect a nozzle opening 18, 18' to the pressure generating chambers 3, 3', respectively. The second cover member 9 thus formed is fastened to the bottom of the spacer 8.

To form the actuator unit, sheets of ceramics clay, called green sheets, of the cover members 2 and 9 and spacer 8, are each shaped to have a predetermined thickness, and the resultant green sheets are holed at predetermined locations thereof. The holed green sheets are layered and sintered into an actuator unit. In this case, no adhesive is used for forming the actuator unit 1.

An ink supplying port forming substrate 12 also serves as a substrate on which the actuator unit 1 is fastened. The ink supplying port forming substrate 12 includes ink supplying ports 13 and 13' and through-holes 14 and 14'. The ink supplying ports 13 and 13' are located closer to one end of the pressure generating chambers 3 and 3', respectively. The through-holes 14 and 14' are located closer to the other end of the pressure generating chambers 3 and 3', respectively. The ink supplying port 13, 13' communicatively connects the pressure generating chamber 3, 3' to the common ink chamber 15, 15' to be described later. The through-hole 14, 14' communicatively connects the pressure generating chamber 3, 3' to the nozzle opening 18, 18'.

A common ink chamber forming substrate 19 includes the common ink chambers 15 and 15' that receive ink from an ink tank, not shown, and through-holes 16 and 16' connecting to the nozzle openings 18 and 18'. A nozzle plate 17 is applied to the underside of the common ink chamber forming substrate 19 to seal the common ink chambers 15 and 15'.

The nozzle plate 17 includes the nozzle openings 18 and 18' that respectively communicate with the pressure generating chambers 3 and 3' through the through-holes 11, 14 and 16, and 11', 14' and 16'.

The ink supplying port forming substrate 12, the common ink chamber forming substrate 19 and nozzle plate 17 are coupled together into a flow path unit 20 by thermal welding films, adhesive or the like. The flow path unit 20 and the actuator unit 1 are then coupled together by thermal welding films, adhesive or the like, serving as a recording head.

Figure 2:
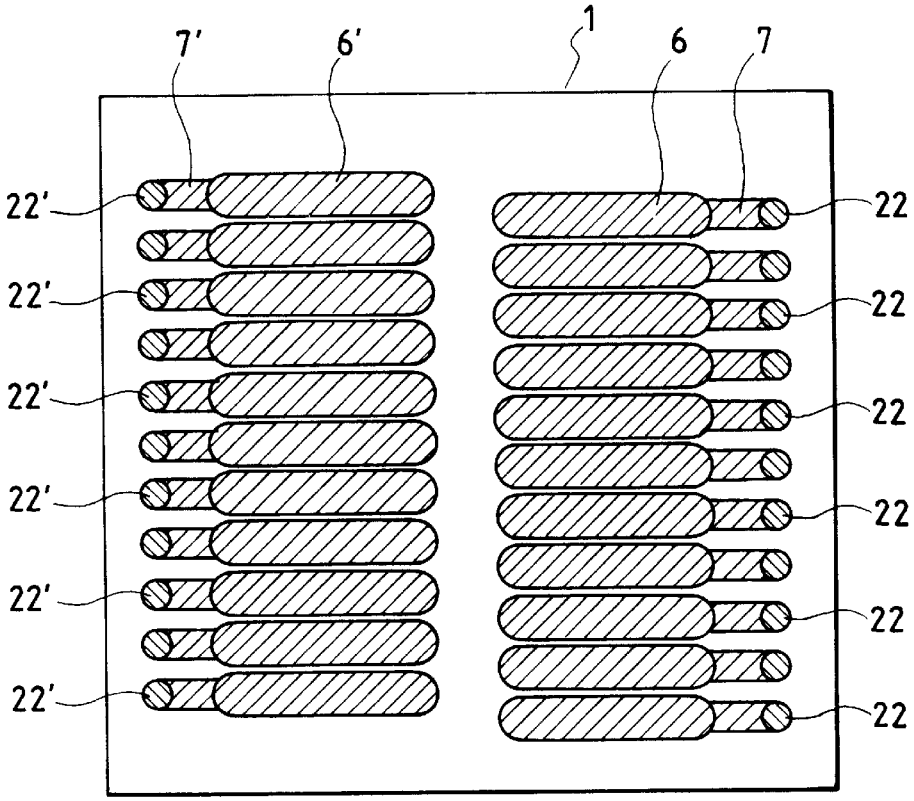
FIG. 2 is a plan view showing a structure on the upper surface of an actuator unit of the print head.

As best illustrated in FIG. 2, terminals 22 and 22' are, respectively, silver or copper electrodes formed by applying conductive material having a bonding ability, e.g., solder chips or conductive adhesive, to the surfaces of the extremities of the conductive patterns 7 and 7', which are the extended parts of the discrete electrodes 6 and 6'.

Figure 3:
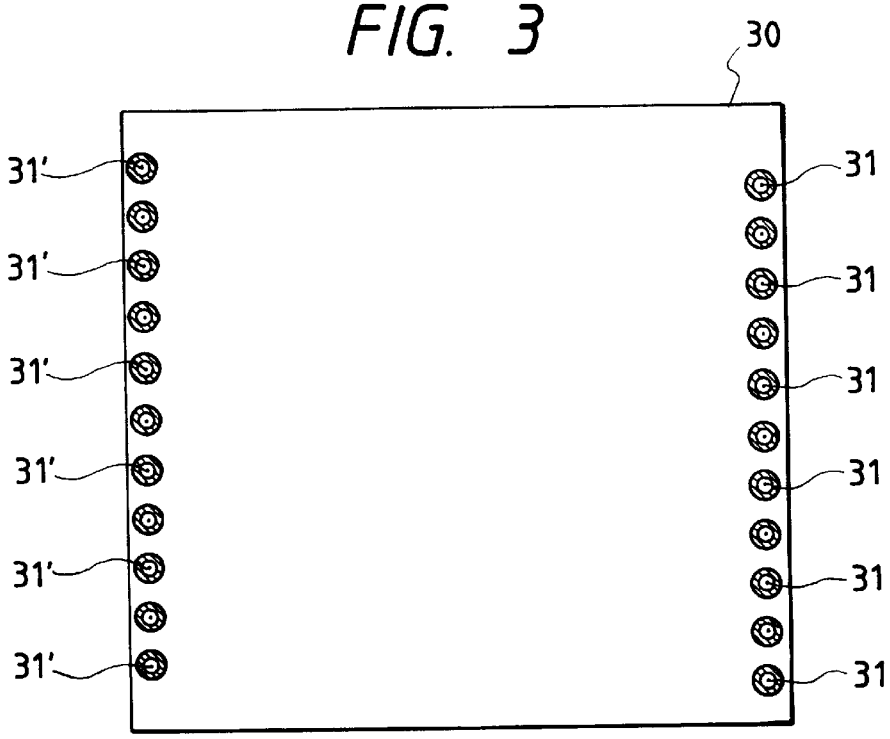
FIG. 3 is a plan view showing the terminal arrays of a semiconductor integrated circuit fastened to the print head.
Figure 4:
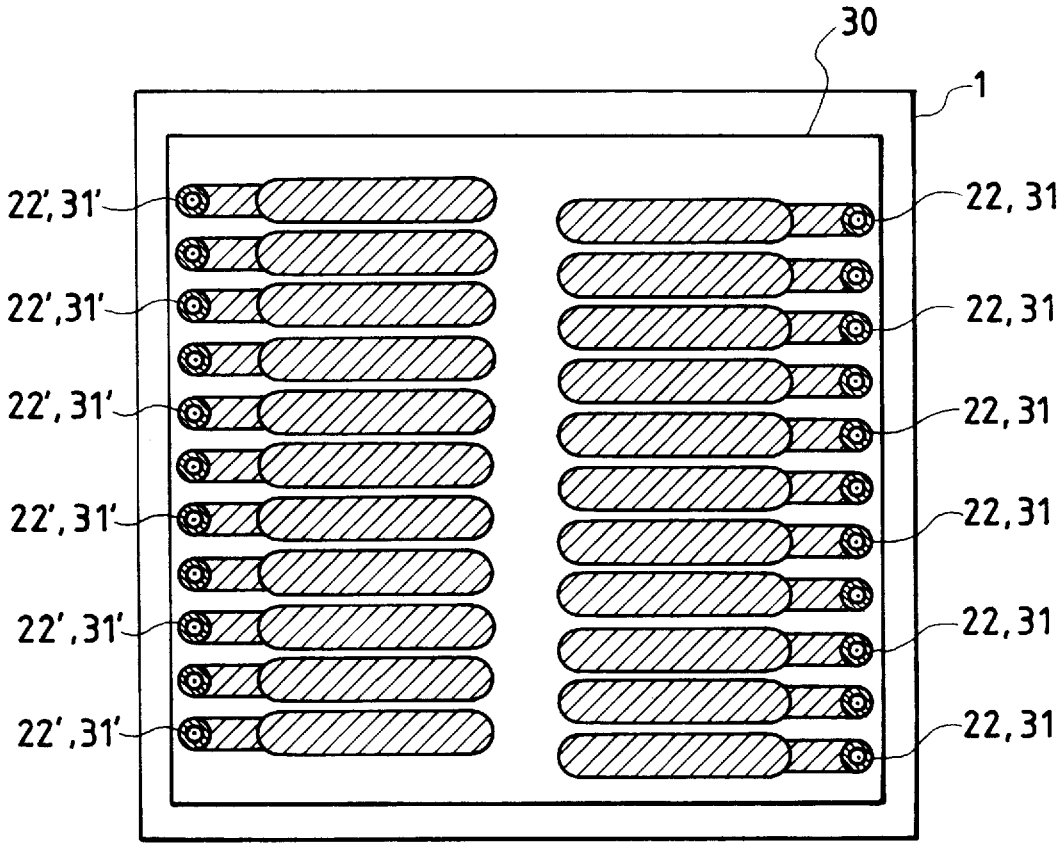
FIG. 4 is a cross sectional view showing a relationship between a semiconductor integrated circuit and an actuator unit.

A semiconductor integrated circuit 30, as a bear chip in this embodiment, supplies drive signals to the piezoelectric vibrators 5 and 5' when receiving a signal from an external device. As shown in FIG. 3, drive signal output terminals 31 and 31' are arrayed on both sides of the bonding surface of the semiconductor integrated circuit 30 at the same pitches as the terminals 22 and 22' of the actuator unit 1.

The semiconductor integrated circuit 30 is fastened to the actuator unit 1 in a state that the bottom surface of the semiconductor integrated circuit 30 is spaced apart from the surfaces of the piezoelectric vibrators 5 and 5' by a distance H (FIG. 1). In this case, when the terminals 22 and 22', and 31 and 31' are made of conductive adhesive, the adhesive is hardened, and when the terminals are made of solder, the solder is thermally welded.

A flexible cable, which receives a print signal from an external device and supplies it to the semiconductor integrated circuit 30 of the print head, may directly be connected to the semiconductor integrated circuit 30. In another connection or structure of the flexible cable shown in FIG. 1(*b*), conductive patterns 33 are formed on the surface of the semiconductor integrated circuit 30, and a flexible cable 44 is connected to the conductive patterns 33.

The semiconductor integrated circuit 30 receives a serial print signal from an external device, and converts the serial print signal into parallel print signals and outputs them to the discrete electrodes 6 and 6' of the piezoelectric vibrators 5 and 5' through the terminals 31, 22 and 31' and 22'. The piezoelectric vibrators 5 and 5' are simultaneously driven by the parallel print signals.

When the piezoelectric vibrators 5 and 5' are driven, flexure vibrations take place in the vibrators. With the vibration, the pressure generating chambers 3 and 3' contract to shoot forth ink droplets through the nozzle openings 18 and 18'. When the supply of the drive signals is stopped, the vibrations of the vibrators disappear. In this state, ink flows from the common ink chambers 15 and 15' into the pressure generating chambers 3 and 3' through the ink supplying ports 13 and 13'.

Figure 32A:
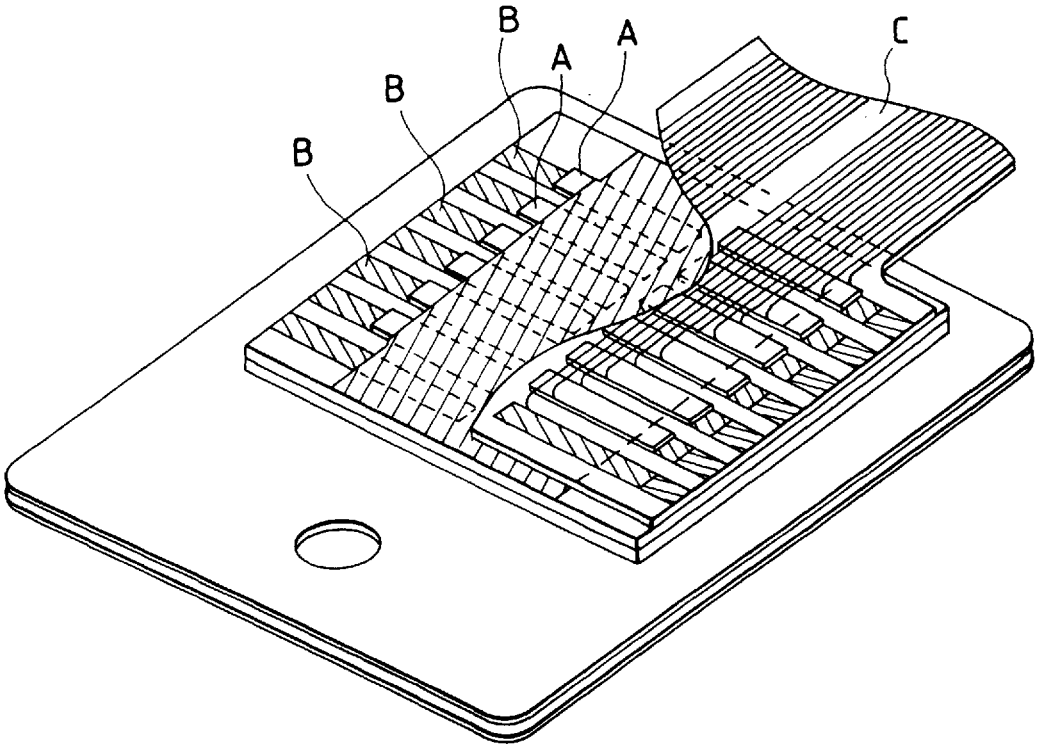
FIG. 32(a) PRIOR ART
FIG. 32(*a*) and 32(*b*) are a perspective view and a cross sectional view showing an ink jet print head.
Figure 32B:
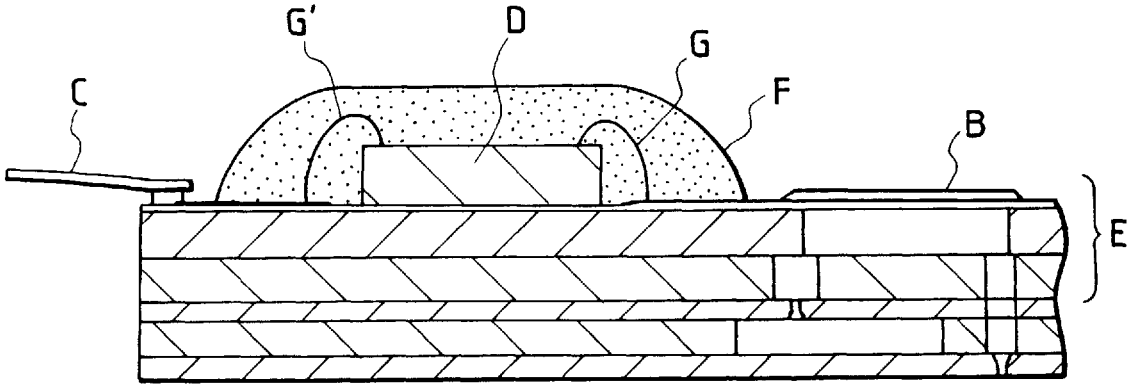

It is noted that distance between the terminals 31 and 31' of the semiconductor integrated circuit 30 and the discrete electrodes 6 and 6' is considerably short when comparing with the flexible cable C shown in FIG. 32(*a*). Therefore, electric resistance between the semiconductor integrated circuit 30 and the discrete electrodes 6 and 6' is extremely small. And the drive signals are applied from the semiconductor integrated circuit 30 to the piezoelectric vibrators 5 and 5' with little attenuation.

The semiconductor integrated circuit 30 is located above the piezoelectric vibrators 5 and 5' and serves as the wall. Accordingly, it noticeably shuts off noise of several kHz, generated when the piezoelectric vibrators 5 and 5' are driven. The semiconductor integrated circuit 30 is bonded to both sides of the actuator unit 1 by adhesive or solder. Because of this, it also serves as a reinforcing plate, which prevents another member from coming in contact with the piezoelectric vibrators 5 and 5'.

Figure 5:
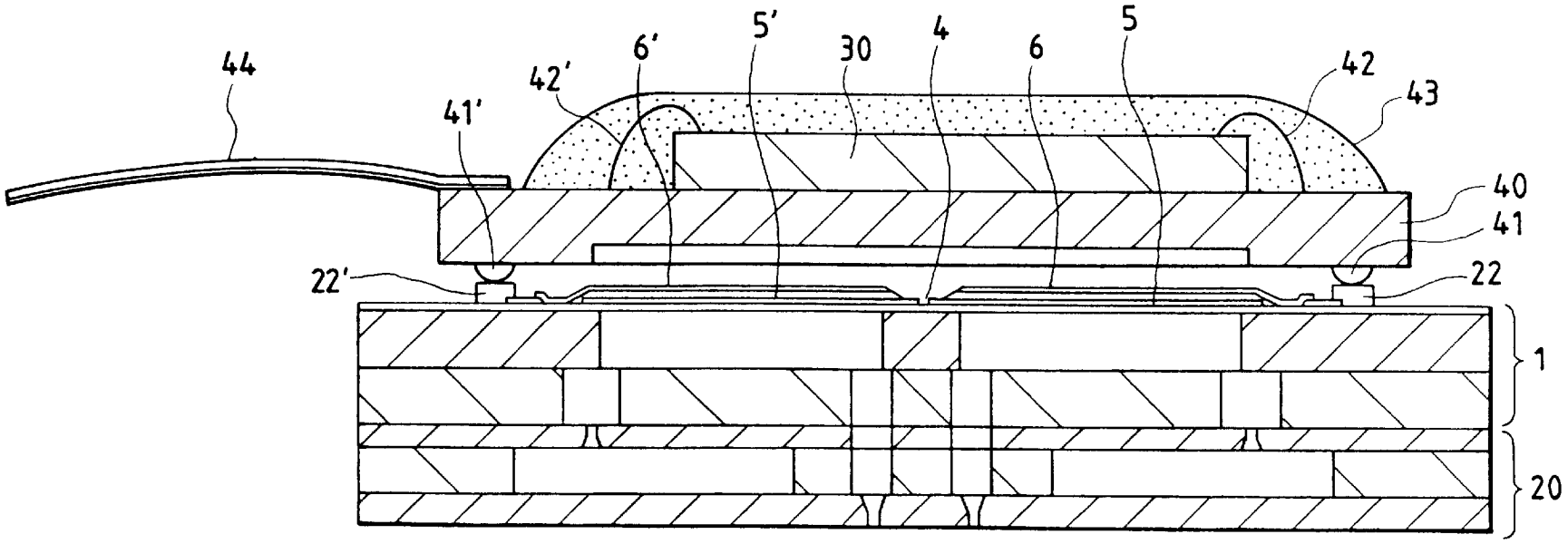
FIG. 5 is a cross sectional view showing another embodiment of the present invention.

FIG. 5 shows another embodiment of an ink jet print head according to the invention. A semiconductor integrated circuit mounting substrate (referred to as an IC mounting substrate) 40 includes terminals 41 and 41', which are arrayed at the same pitches as of the terminals 22 and 22' of the actuator unit 1. The IC mounting substrate 40 supports thereon a semiconductor integrated circuit 30, constructed as a bear chip. The output terminals of the semiconductor integrated circuit 30 are connected to the terminals 41 and 41' by wires 42 and 42', respectively. The semiconductor integrated circuit 30 is fastened onto the surface of the IC mounting substrate 40 and sealed by resin 43.

In this embodiment, the semiconductor integrated circuit 30 may be constructed independently of the size of the, actuator unit 1. The semiconductor integrated circuit 30 may be adapted to any type of the actuator unit, for example, a large actuator unit, by merely using the IC mounting substrate 40 selected according to the size of the actuator unit. This leads to the cost reduction of the semiconductor integrated circuit 30.

A flexible cable 44 for connecting the print head to an external device may be connected to the IC mounting substrate 40. Therefore, in the soldering work, a little heat is transferred to the actuator unit 1.

Figure 6:
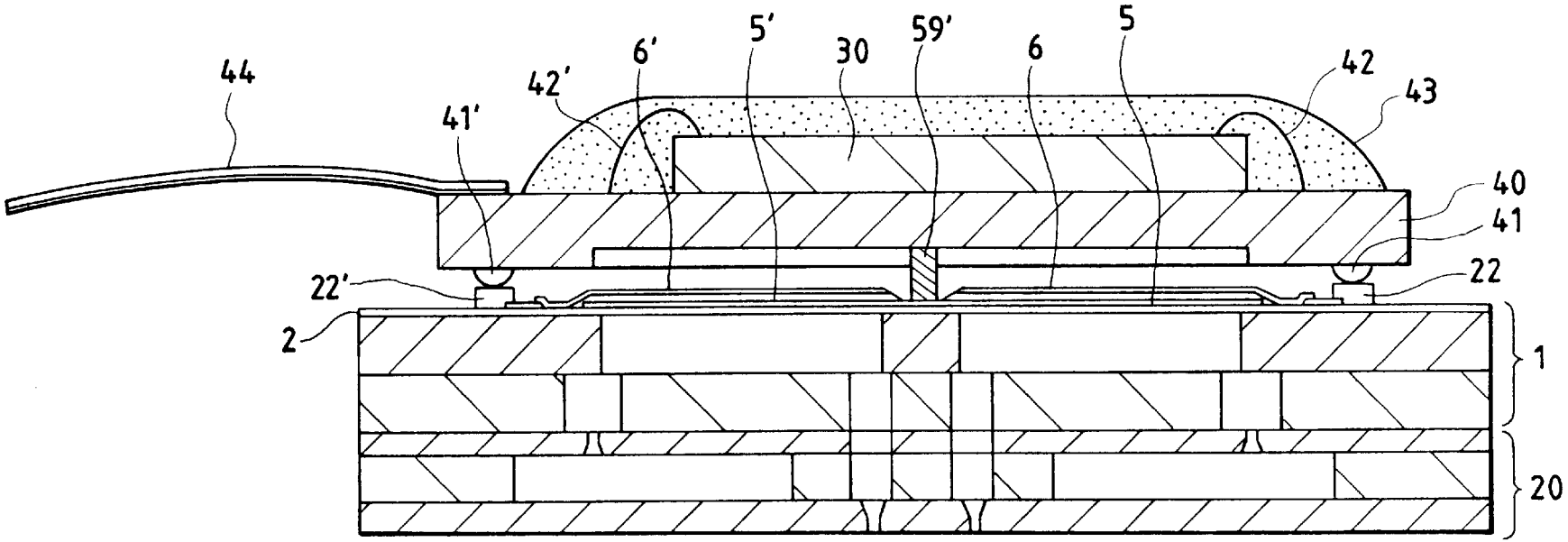
FIG. 6 is a cross sectional view showing still another embodiment of the invention.

FIG. 6 shows yet another embodiment of an ink jet print head according to the invention. In this embodiment, at least one support 59', made of electrically insulating material, is placed in the middle part of the actuator unit 1 where neither of the piezoelectric vibrators 5 and 5' is present. The support 59' is high enough to form such a gap as to prevent the IC mounting substrate 40 from being brought into contact with the piezoelectric vibrators 5 and 5', and to such an extent that the top of the support 59' reaches the rear side or surface of the IC mounting substrate 40.

Since the support 59' supports the IC mounting substrate 40, the print head of the embodiment is free from a warp of the print head caused by the weight concentrated on both sides of the print head.

Figure 7:
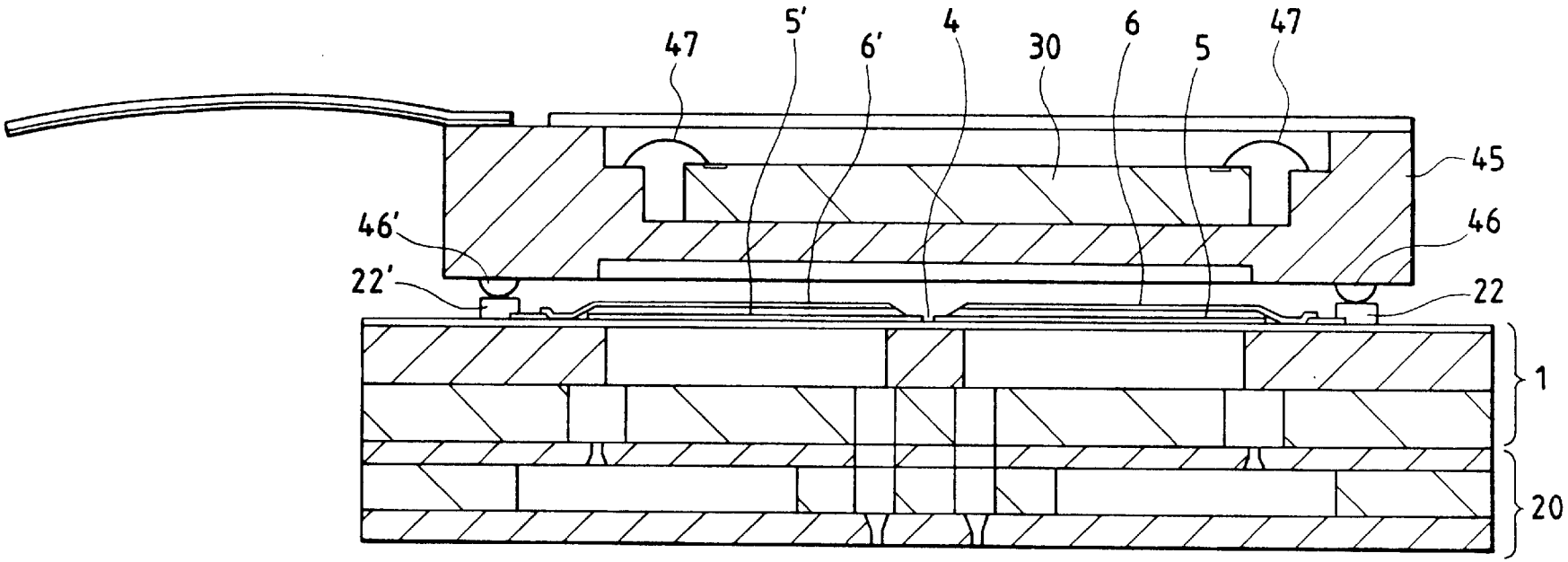
FIG. 7 is a cross sectional view showing yet another embodiment of the invention.

FIG. 7 shows still another embodiment of an ink jet print head according to the invention. In this embodiment, a semiconductor integrated circuit 30 is put in a package 45. Terminals 46 and 46', arrayed at the same pitches as of the terminals 22 and 22' of the actuator unit 1, are formed on the bottom surface of the package 45. The output terminals of the semiconductor integrated circuit 30 are connected to the terminals 46 and 46' by wires 47 and 47', respectively.

In this embodiment, the pitches of the arrays of the terminals 46 and 46' of the package 45 are coincident with those of the arrays of the terminals 22 and 22'. Therefore, a proper semiconductor integrated circuit 30, currently marketed, may be applied to various types of actuator units. With the flexible application of the semiconductor integrated circuit 30, the reduction of cost to manufacture is realized. In the work of soldering the flexible cable, the actuator unit 1 will not be excessively heated.

Figure 8:
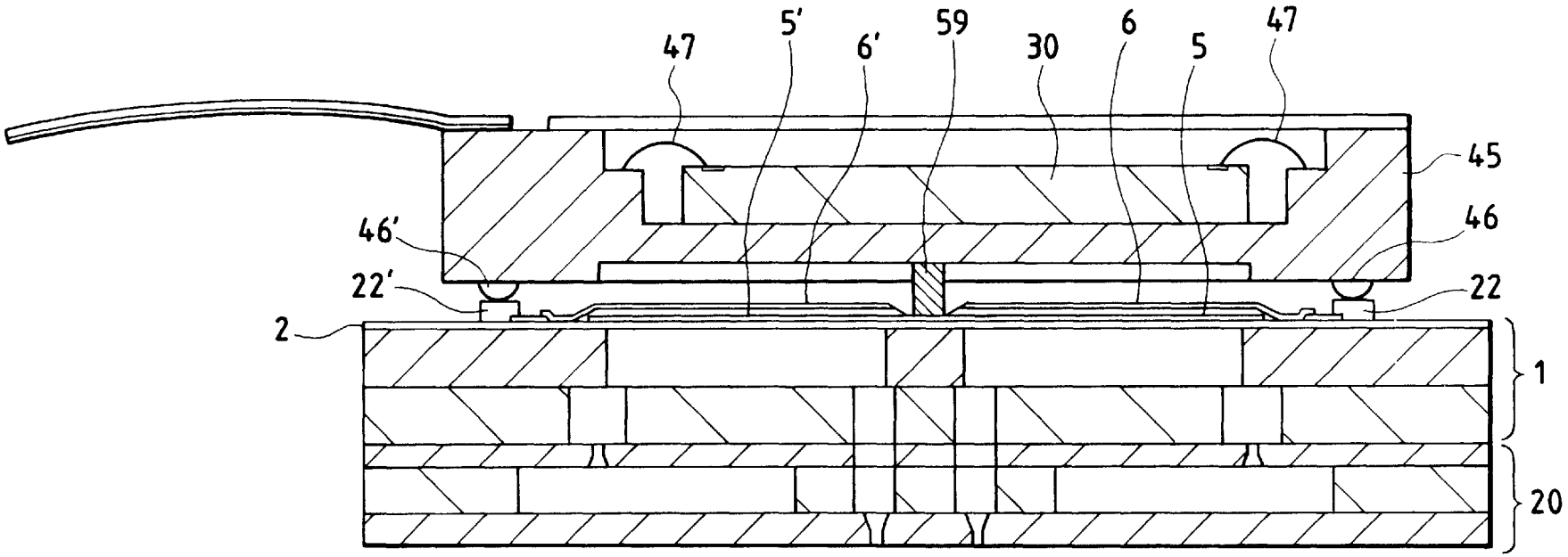
FIG. 8 is a cross sectional view showing a further embodiment of the invention.

FIG. 8 shows an additional embodiment of an ink jet print head according to the invention. As shown, at least one support 59, made of electrically insulating material, is placed in the middle part of the actuator unit 1 where neither of the piezoelectric vibrators 5 and 5' is present. The support 59 is high enough to form such a gap as to prevent the IC mounting substrate 40 from being brought into contact with the piezoelectric vibrators 5 and 5', and to such an extent that the top of the support 59 reaches the rear side of the package 45.

Since the support 59 supports the central part of the package 45, the print head of the embodiment is free from a warp of the print head caused by the weight acting concentrically on both sides of the print head.

Figure 9:
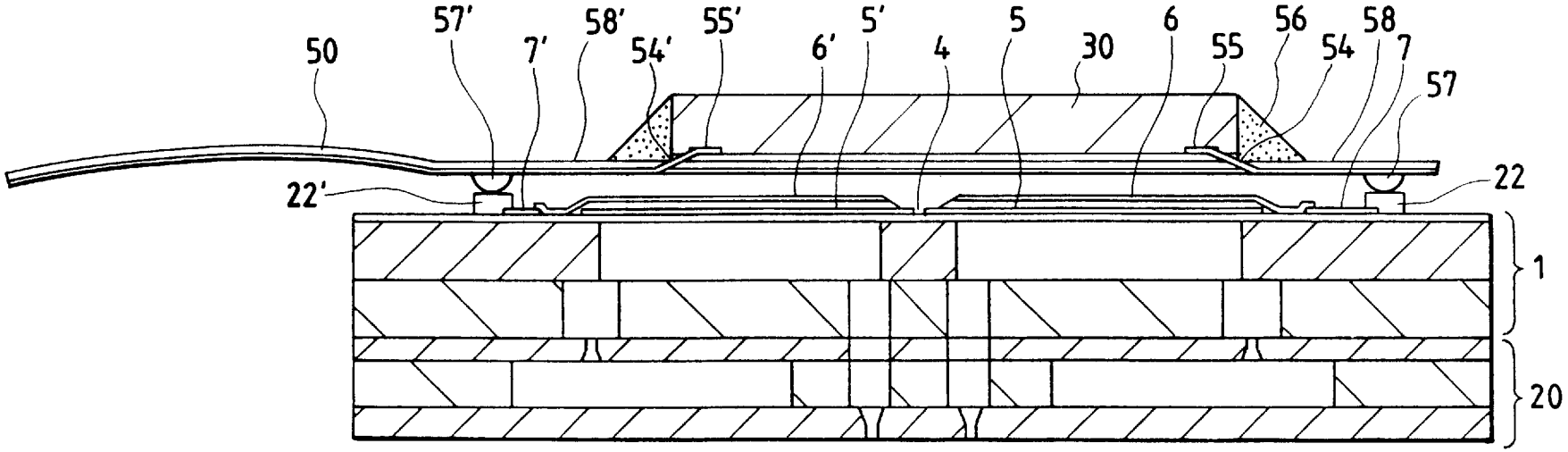
FIG. 9 is a cross sectional view showing an additional embodiment of the invention.
Figure 10:
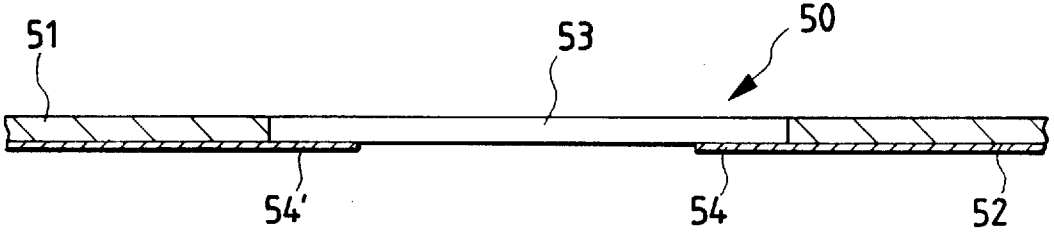
FIG. 10 is a cross sectional view showing an example of a flexible cable used in the invention.

FIG. 9 shows a further embodiment of an ink jet print head according to the invention. The print head of the invention uses a flexible cable 50 as illustrated in FIG. 10. As shown, the flexible cable 50 has a layered structure including a heat resistant insulating film 51 made of polyimide, for example, and a metal foil 52 made of copper, for example, and may be soldered to the heat resistant insulating film 51.

The width of the flexible cable 50 is so selected as to entirely cover the arrays of the terminals 22 and 22'.

A window 53 is formed in a region of the flexible cable 50 where is to be located above the central portion of the actuator unit 1 when the flexible cable is mounted on the actuator unit. The size of the window 53 is located such that the signal output terminals 55 and 55' of the semiconductor integrated circuit 30 face the piezoelectric vibrators 5 and 5' and seen from outside through the window.

Tabs 54 and 54' extend from the metal foil 52 into the window 53, while being arrayed corresponding in position to the signal output terminals 55 and 55' of the semiconductor integrated circuit 30. After the tabs 54 and 54' are soldered to the signal output terminals 55 and 55', at least the fringe of the semiconductor integrated circuit 30 is sealed with resin 56, to complete the mounting of the flexible cable 50 on the semiconductor integrated circuit 30. Spherical terminals 57 and 57' are formed on the rear side of the flexible cable 50 while being arrayed corresponding in position to the arrays of the terminals 22 and 22' of the actuator unit 1. Those terminals are connected to the semiconductor integrated circuit 30 through conductive patterns 58 and 58' that extend from the tabs 54 and 54'.

In this embodiment, the spherical terminals 57 and 57' of the flexible cable 50 or the terminals 22 and 22' of the actuator unit 1 are designed to have preferably such a thickness that the rear side of the flexible cable 50 is located above the piezoelectric vibrators 5 and 5'. If so selected, the following advantages are obtained. The flexible cable 50 is prevented from brought into contact with the piezoelectric vibrators 5 and 5'. Further, the spherical terminals 57 and 57' of the flexible cable 50 is relatively easily soldered to the terminals 22 and 22' of the actuator unit 1 by heating those terminals through the heat resistant insulating film 51.

Figure 11:
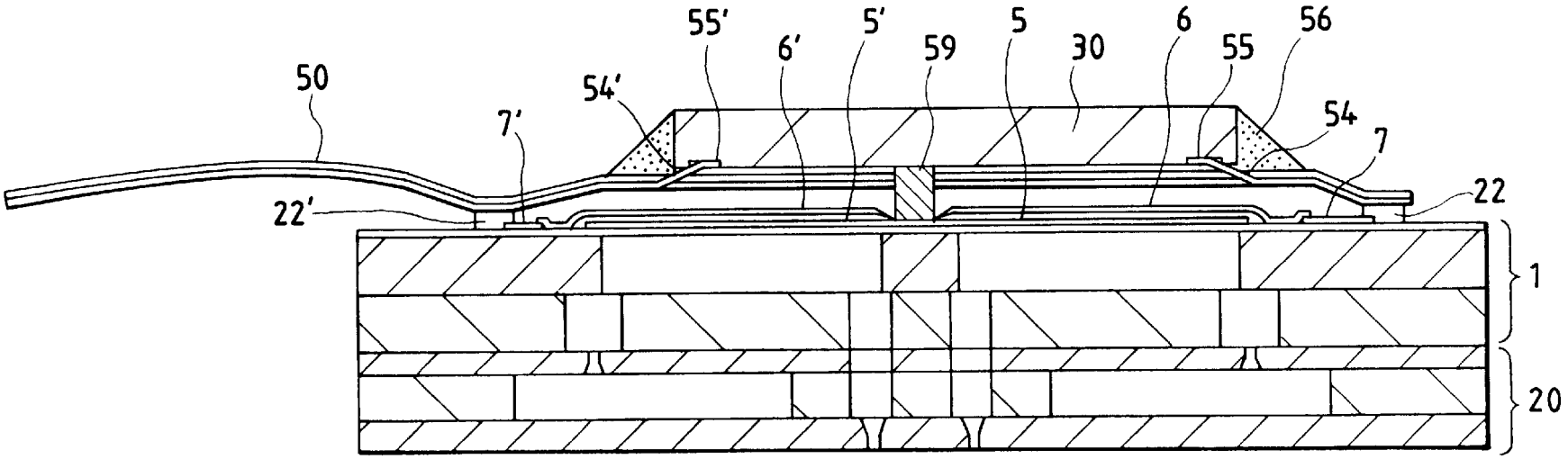
FIG. 11 is a cross sectional view showing an embodiment of the invention.

FIG. 11 shows another embodiment of an ink jet print head according to the invention. As shown, at least one support 59, made of electrically insulating material, is placed in the middle part of the actuator unit 1 where neither of the piezoelectric vibrators 5 and 5' is present. The support 59 is high enough to form such a gap as to prevent the flexible cable 50 from being brought into contact with the piezoelectric vibrators 5 and 5', and to such an extent that the top of the support 59 reaches the rear side of the semiconductor integrated circuit 30.

In this embodiment, the support 59 supports the semiconductor integrated circuit 30 and forms a fixed gap between the rear side of the flexible cable 50 and the piezoelectric vibrators 5 and 5'. Therefore, there is no need of using the spherical terminals 57 and 57' for lifting the flexible cable 50. Further, the conductive patterns 58 and 58' may directly be connected to the terminals 22 and 22' by soldering.

The support 59 receives the weight of the semiconductor integrated circuit 30. Accordingly, the semiconductor integrated circuit 30 is not warped, and not brought into contact with the piezoelectric vibrators 5 and 5'. There is no chance that the weight of the semiconductor integrated circuit 30 and the flexible cable 50 concentrically act on both sides of the print head, to thereby warp the print head. Further, the protrusions receive force accidentally applied from above. The resultant print head is free from the detrimental contact and warp.

Figure 12:
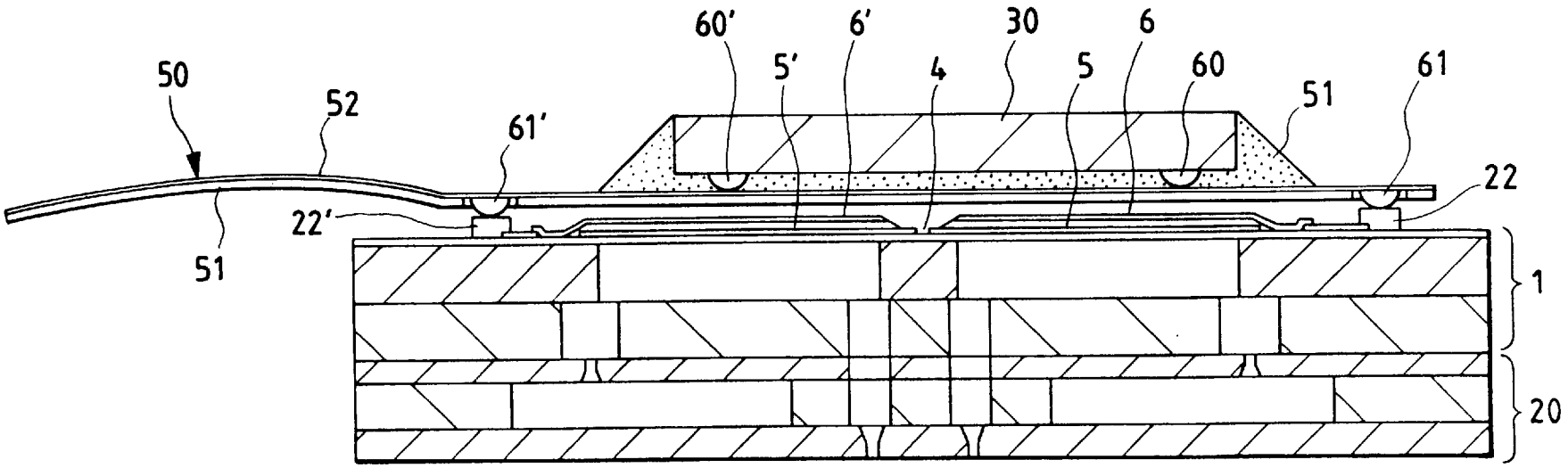
FIG. 12 is a cross sectional view showing another embodiment of the invention.

FIG. 12 shows another embodiment of an ink jet print head according to the invention. In the above-mentioned embodiments, the semiconductor integrated circuit 30 is connected to the flexible cable 50 through the tabs 54 and 54'. To connect the semiconductor integrated circuit 30 to the flexible cable 50, the present embodiment uses a connection structure as shown in FIG. 12. As shown, the semiconductor integrated circuit 30 includes terminals 60 and 60' protruded from the rear side thereof. In mounting the flexible cable 50, the metal foil 52 thereof is directed upward. The protruded terminals 60 and 60' are soldered to the metal foil 52 of the flexible cable 50.

To connect the flexible cable 50 to the actuator unit 1, the flexible cable 50 has the terminals 61 and 61'. The terminals 61 and 61' are formed at the locations on the rear side of the flexible cable 50, which face respectively the terminals 22 and 22' of the actuator unit 1. At the locations of the flexible cable 50, the heat resistant insulating film 51 is cut out and accordingly the metal foil 52 is uncovered with the film. The terminals 61 and 61' are formed on those uncovered metal foil 52 at such a height as to provide a gap between the underside of the flexible cable 50 and the piezoelectric vibrators 5 and 5'. In this case, solder chips or conductive adhesive is used for the formation of the terminals 61 and 61'. The flexible cable 50 is connected at the terminals 61 and 61' as well as to the terminals 22 and 22' of the actuator unit 1.

Figure 13:
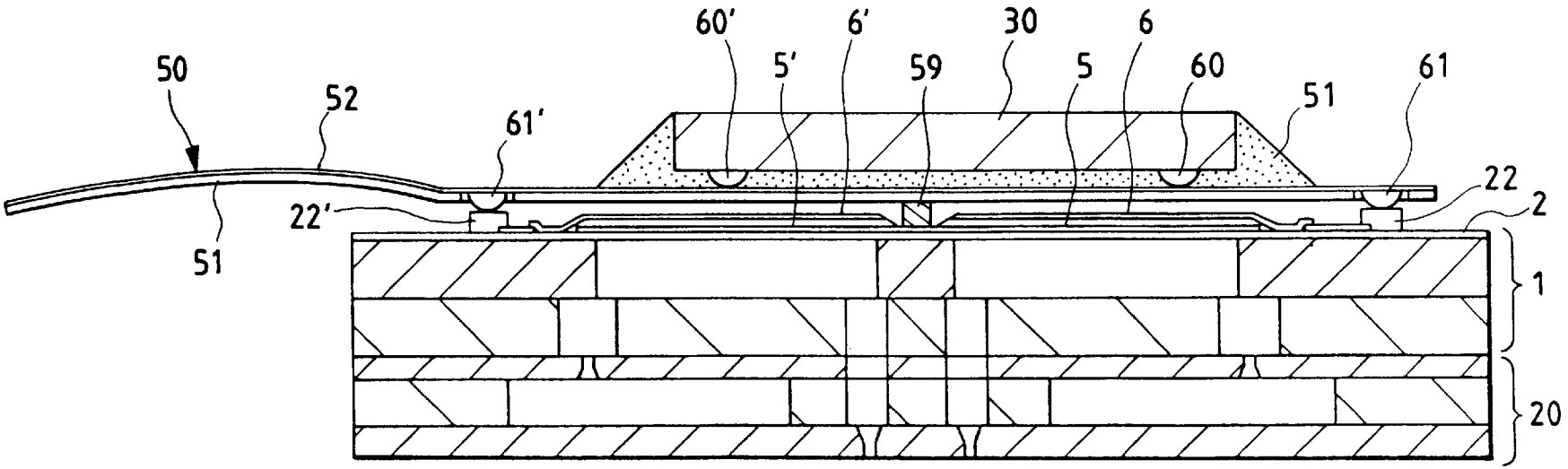
FIG. 13 is a cross sectional view showing still another embodiment of the invention.

FIG. 13 shows yet another embodiment of an ink jet print head according to the invention. As shown, at least one support 59 is placed in the middle part of the actuator unit 1 where neither of the piezoelectric vibrators 5 and 5' is present. The support 59 is high enough to form such a gap as to prevent the flexible cable 50 from being brought into contact with the piezoelectric vibrators 5 and 5', and to such an extent that the top of the support 59 reaches the rear side of the flexible cable 50. With provision of the support 59, there is no chance that the flexible cable 50 comes in contact with the piezoelectric vibrators 5 and 5'.

In the above-mentioned embodiments, the discrete electrodes 6 and 6' are formed on the surfaces of the piezoelectric vibrators 5 and 5'.

Also in an ink jet print head of the type in which the discrete electrodes are formed on the surface of the first cover member 2 and the common electrode is formed on the surfaces of the piezoelectric vibrators 5 and 5', the above-mentioned method is available if the discrete electrodes can be led to the side ends of the first cover member by the lead portions.

Figure 14:
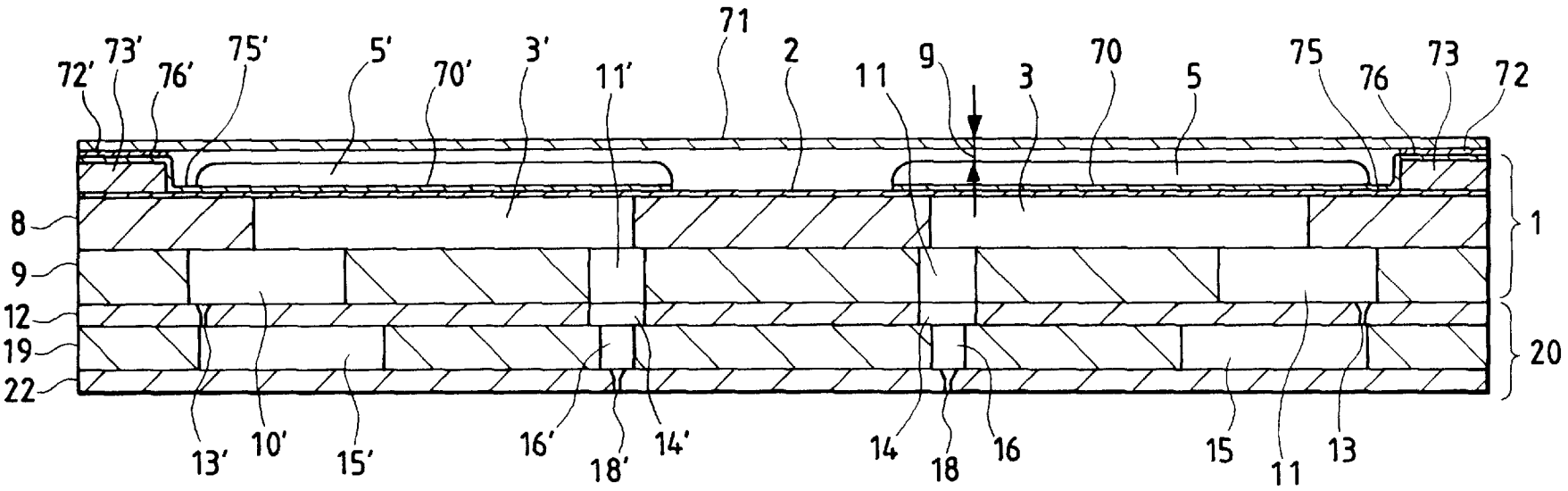
FIG. 14 is a cross sectional view showing still another embodiment of an ink jet print head according the present invention, the illustration showing a structure in the vicinity of the pressure generating chambers oppositely arrayed.

FIG. 14 shows an embodiment of an ink jet print head according to another aspect of the present invention. In the present embodiment, discrete electrodes 70 and 70' of the actuator unit 1 are formed as lower electrodes on the surface of the first cover member 2. A common electrode, not shown, is formed on the surfaces of the piezoelectric vibrators 5 and 5'.

Reference numeral 71 designates a flexible cable for connecting the discrete electrodes 70 and 70' to an external drive circuit. Conductive patterns 72 and 72' are respectively formed at the extremities of the patterns of the flexible cable 71 for connecting signals from the external drive circuit to the discrete electrodes 70 and 70'. The conductive patterns 72 and 72' are arrayed at the same pitches as of terminals 73 and 73' connecting to the discrete electrodes 70 and 70'.

Figure 15:
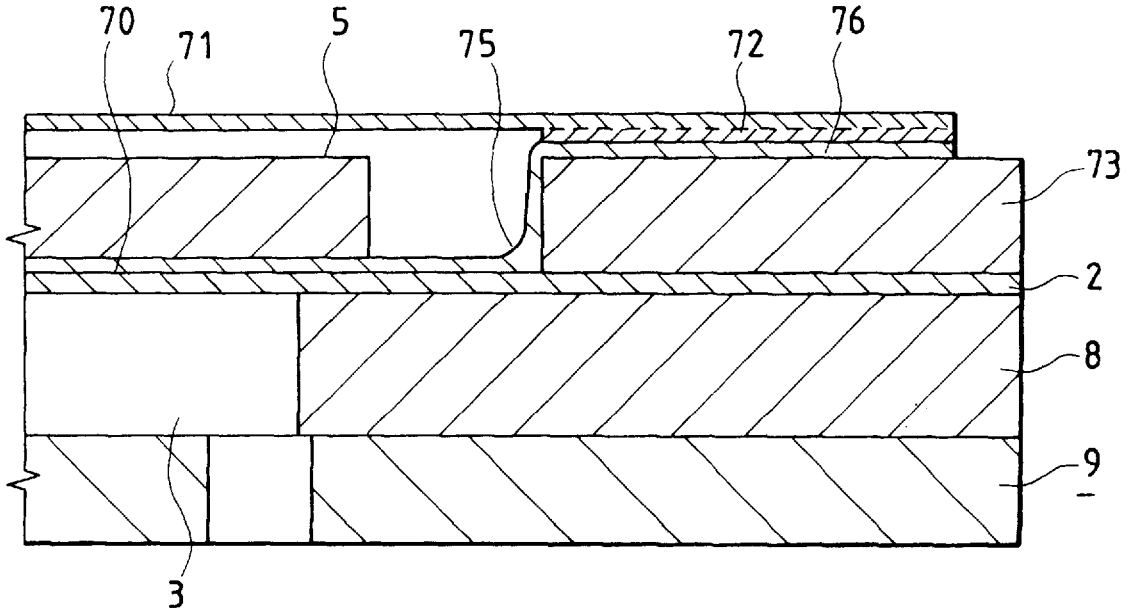
FIG. 15 is an enlarged and partial sectional view showing a connection structure of one side of the print head, which is for connecting the discrete electrodes to the flexible cable.

FIG. 15 is an enlarged and partial sectional view showing a connection structure of one side of the print head, which is for connecting the discrete electrodes 70 and 70' to the flexible cable 71. As shown, the terminal 73 is formed on the surface of the first cover member 2. In this embodiment, it is made of electrically insulating material, and the thickness of the terminals 73, 73' is selected so that the upper surfaces of the terminals 73, 73' are higher than the surfaces of the piezoelectric vibrators 5.

Figure 16:
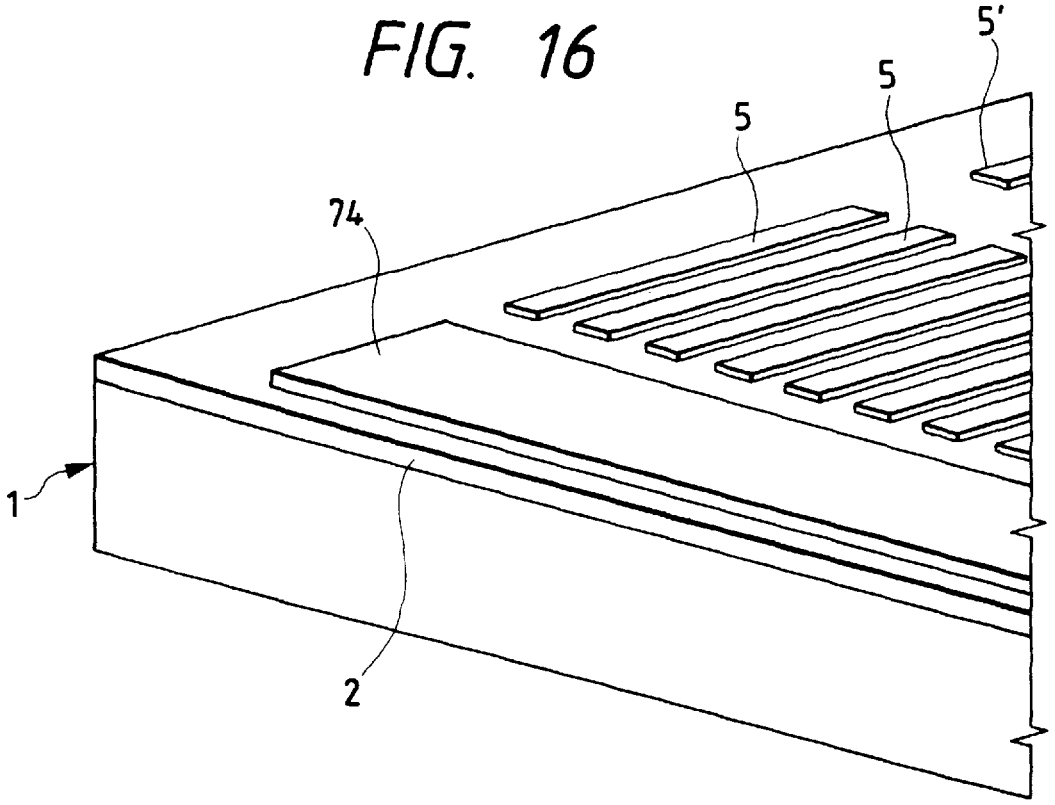
FIG. 16 is a perspective view showing an example of the terminal that may be used in the invention.

The terminals 73, 73' may be formed in a manner that as shown in FIG. 16, a plate made of electrically insulating material and having the thickness stated above, for Example. A thin plate 74 made of ceramics, for example, is bonded to an area of the surface of the first cover member 2, which is close to and along the side edge of the cover member surface or that a green sheet of ceramics is stuck on that surface area of the first cover member 2, and sintered in the sintering process of the piezoelectric vibrators 5.

Returning to FIG. 14, lead portions 75 and 75' extend from the discrete electrodes 70 and 70' to the surfaces of the terminals 73, 73', respectively. The lead portions 75 and 75' may be formed by evaporation process. The lead portions 75 and 75' provide junction parts 76 and 76' on the surfaces of the terminals 73, 73', respectively.

In this embodiment, the conductive patterns 72 and 72' of the flexible cable 71 are soldered to the junction parts 76 and 76' in the following steps:

a) applying solder paste to the locations on the surfaces of the junction parts 76 and 76', which correspond in width to the discrete electrodes 70 and 70' and are arrayed at the same pitches as of the discrete electrodes 70 and 70', b) extending the flexible cable 71 over two arrays of the piezoelectric vibrators 5 and 5', c) positioning the conductive patterns 72 and 72' with respect to the junction parts 76 and 76' of the terminals 73 (73') and d) heating the surface of the flexible cable 71. Heat is transferred through the heat resistant insulating film of the flexible cable 71 to the solder paste, to melt the solder paste.

After the soldering work ends, the flexible cable 71 is fixed at both ends to the terminals 73, 73' and held in a state that a gap a, determined by the height of the terminals 73, 73', is formed between the lower surface of the flexible cable 71 and the upper surfaces of the piezoelectric vibrators 5 and 5'.

Accordingly, the flexible cable 71 will not be in contact with the piezoelectric vibrators 5 and 5', and the thin plates of the terminals 73, 73' serve also as reinforcing members.

Figure 17:
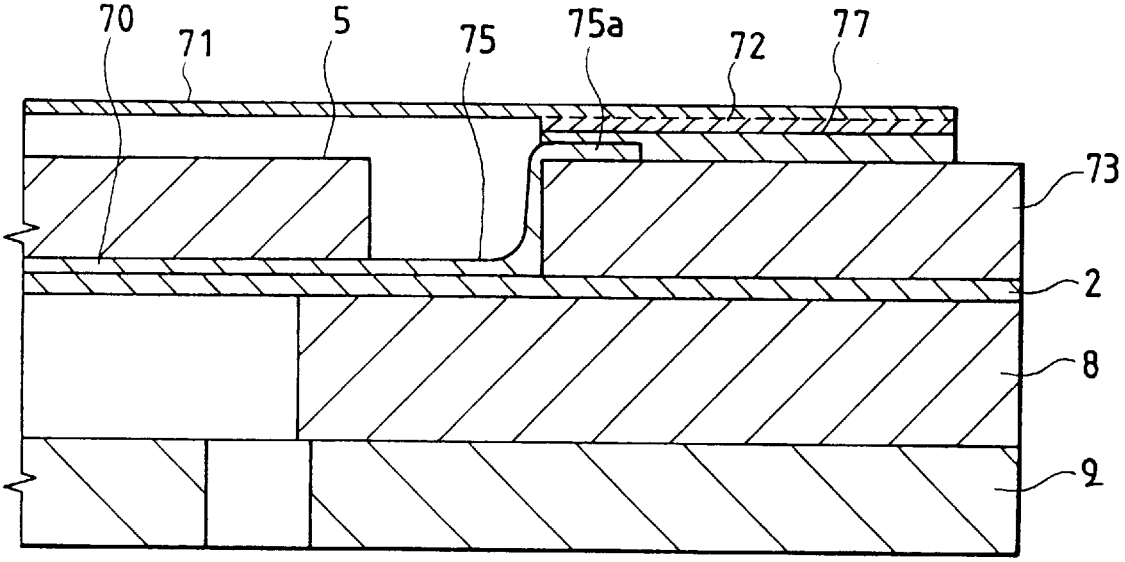
FIG. 17 is a sectional view showing another connection structure of the lead portions to the conductive patterns.

In the embodiment mentioned above, the conductive patterns 72 and 72' of the flexible cable 71 are directly soldered to the junction parts 76 and 76' as the extended parts of the lead portions 75 and 75'. Another connection structure of the lead portions to the conductive patterns is illustrated in FIG. 17. As shown, the extreme parts 75*a* and 75*a'* of the lead portions 75 and 75' extend to the terminals 73 (73'). Junction layers 77 and 77', which are made of metal suitable for soldering connection and correspond in width to the discrete electrodes, are arrayed on the surfaces of the terminals 73 (73'), while being electrically continuous to the extreme parts 75*a* and 75*a'*. The conductive patterns 72 and 72' of the flexible cable 71 are soldered to the junction layers 77 and 77', respectively.

In this embodiment, provision of the junction layer 77 increases the thickness of the whole structure defined by the junction part 76 on the terminals 73 (73'). Accordingly, if the green sheets of piezoelectric material for the piezoelectric vibrators 5 are used for the thin plate 74 (FIG. 16) as they are, the thickness of the junction layer 77 surely provides the gap q.

Figure 18:
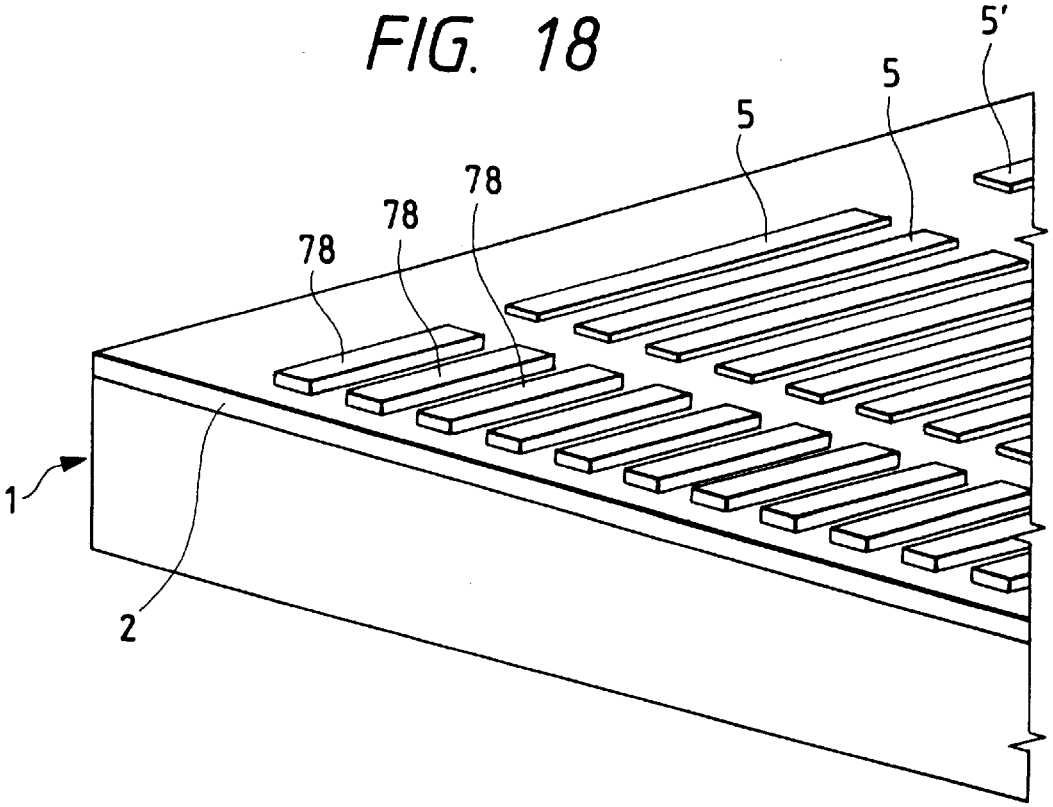
FIG. 18 is a perspective view showing another example of the terminals that may be used in the invention.

In the above-mentioned embodiment, the terminals 73, 73' are formed using the long, rectangular thin plate 74. Alternatively, strips 78, 78' which arrayed corresponding in position to the arrays of the discrete electrodes 70, 70' as shown in FIG. 18, may be used in place with the thin plate 74.

Figure 19:
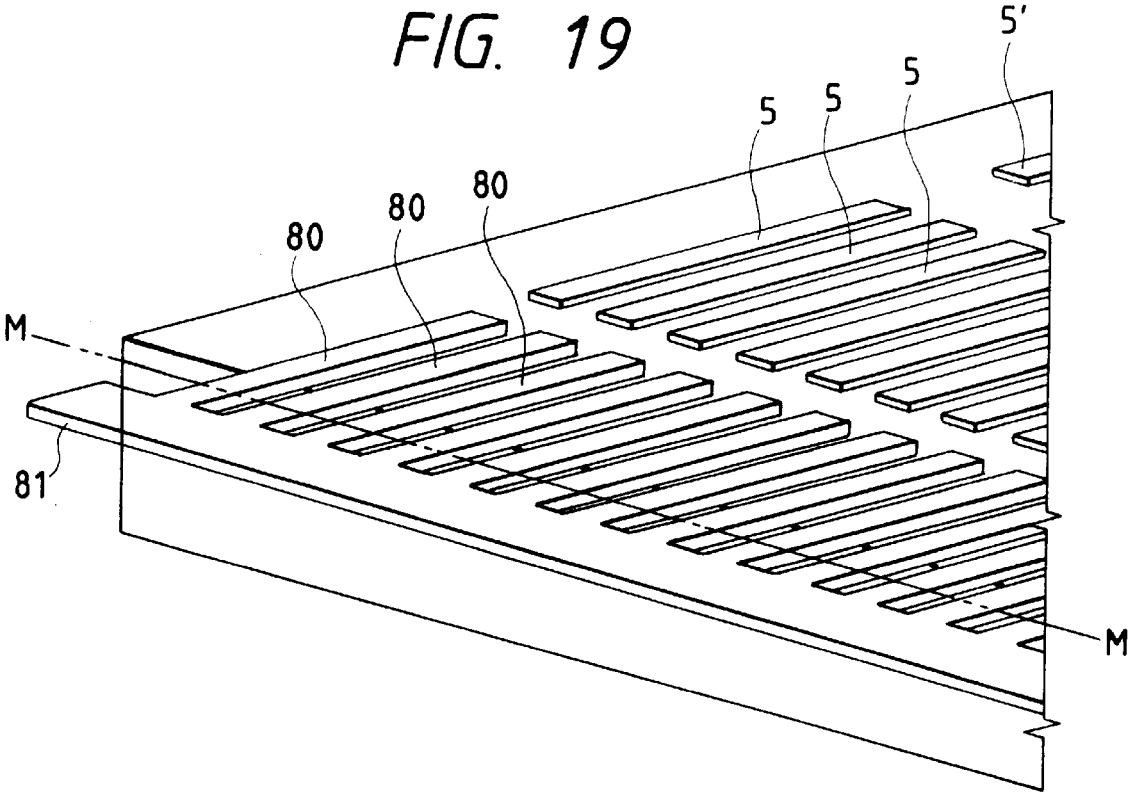
FIG. 19 is a perspective view showing still another example of the terminals that may be used in the invention.

FIG. 19 shows an embodiment of an ink jet print head of which the terminals 73, 73' are formed of the strip array 78, 78'. As shown, a comb like member, made of ceramics, for example, comprises teeth 80 and a base 81 from which the teeth 80 extend. These teeth 80 are arrayed at the same pitches as of the discrete electrodes 70, 70'. The comb like member is fastened to the first cover member 2, and then the base 81 is cut out along a line M—M.

Figure 20:
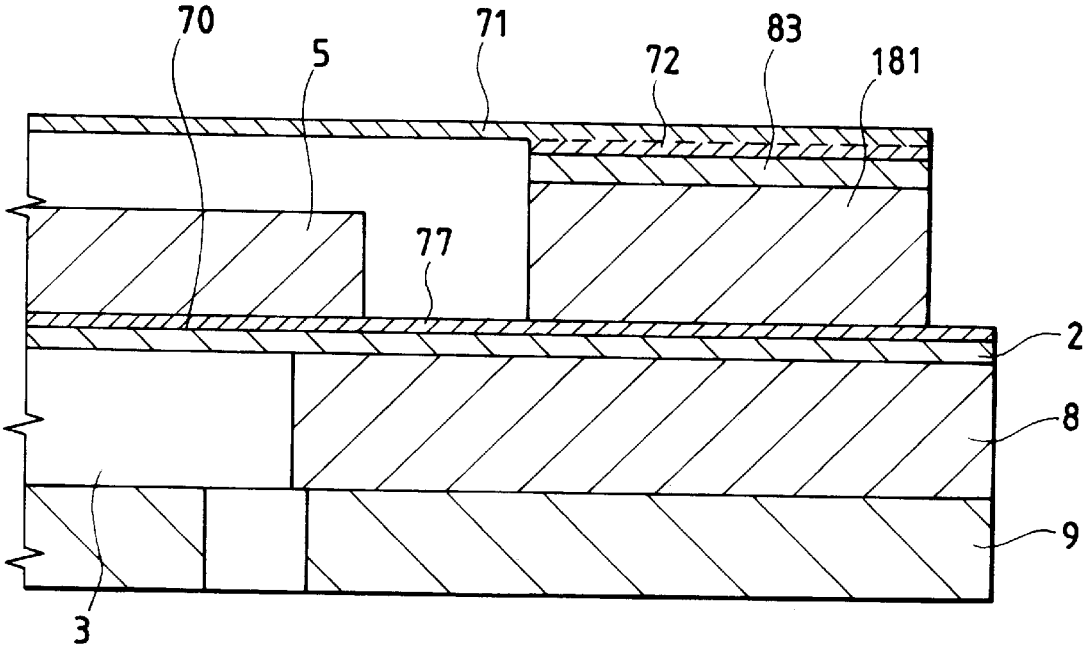
FIG. 20 is a sectional view showing still another connection structure of a flexible cable to the discrete electrodes according to the invention.
Figure 21:
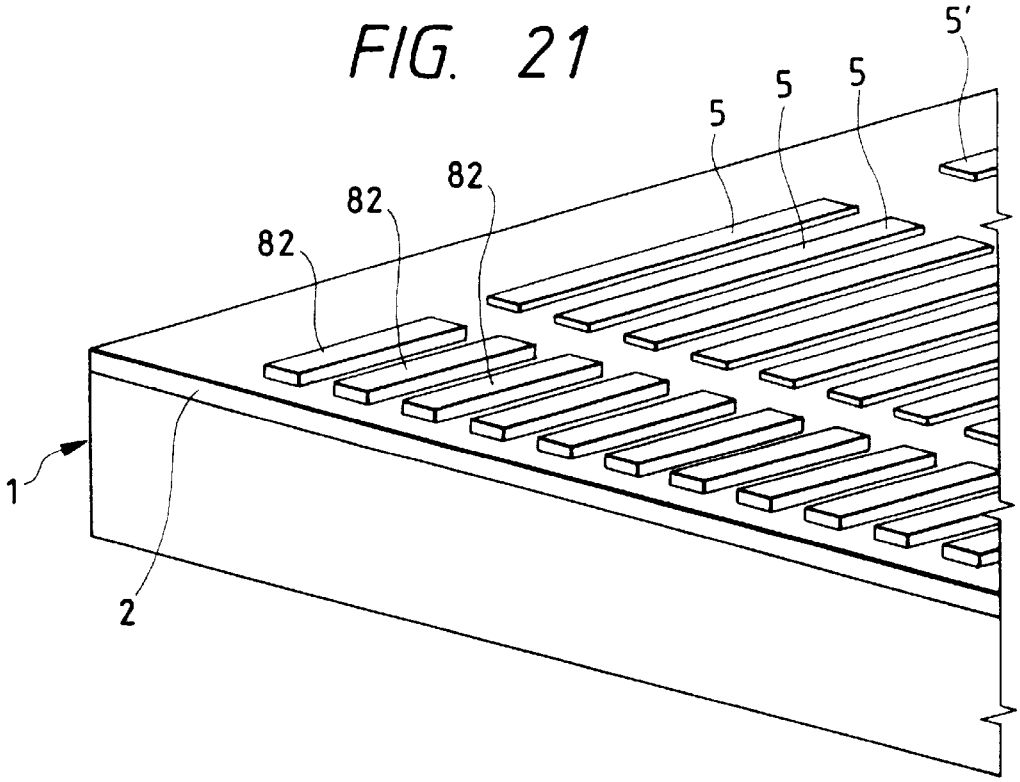
FIG. 21 is a perspective view showing yet another example of the terminals that may be used in the invention.

FIG. 20 shows another embodiment of an ink jet print head according to the invention. In the figure, reference numeral 181 stands for a terminal made of conductive material. As shown in FIG. 21, the lead portions 75, 75' connecting to the discrete electrodes 70, 70' extend up to the side end of the first cover member 2. Strip-like conductive substrates 82 are secured to the surfaces of them by conductive adhesive. Then, junction parts 83 are formed on the surfaces of the strip-like conductive substrates 82. The junction parts 83 are made of metal, for example, silver, which is suitable for the soldering thereto of the conductive patterns 72, 72' of the flexible cable 71.

Figure 22:
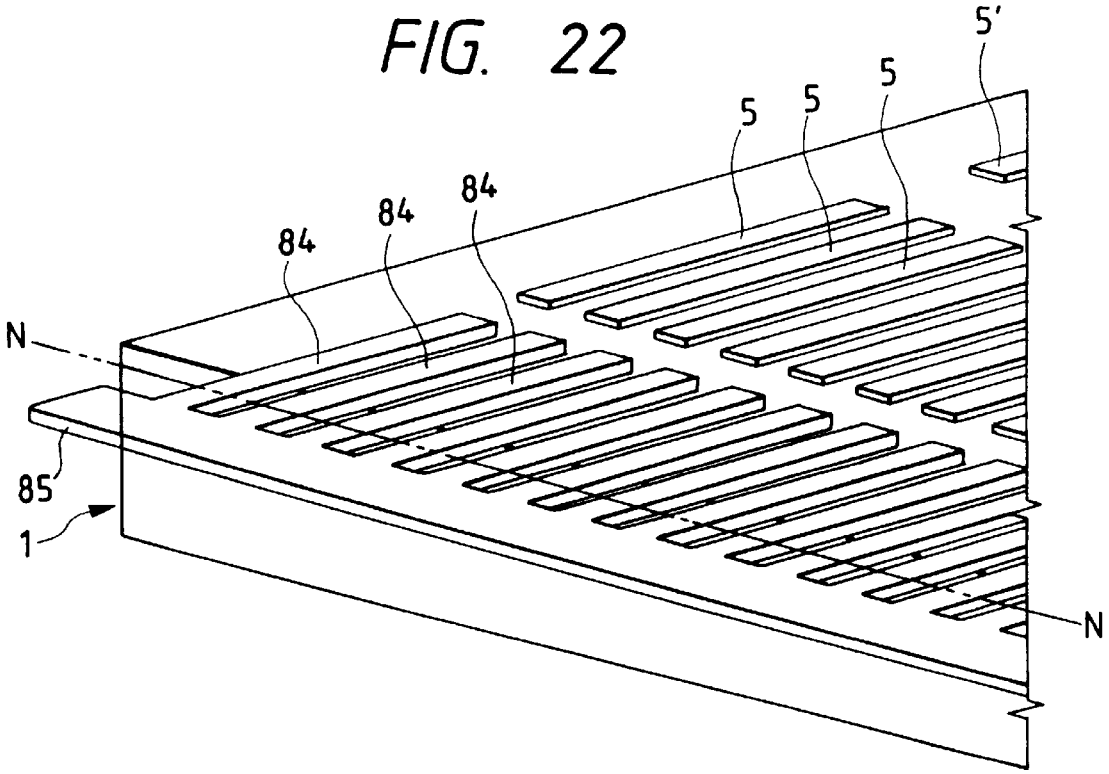
FIG. 22 is a perspective view showing a further example of the terminals that may be used in the invention.

Also in this embodiment, the terminals 73, 73' may be formed of the comb-like member. Accordingly, the manufacturing process of the print head is simplified. A comb like member is formed by press work. The comb like member, as shown in FIG. 22, comprises portions 84 to be fastened to the first cover member 2 as strip-like conductive substrates 82, which are thin conductive strips made of metal arrayed at the same pitches as of the discrete electrodes 70, 70', and a base 85 from which the portions 84 extend. The portions 84 serving as the strip-like conductive substrates 82 are fastened onto the first cover member 2. The base 85 is cut out along a line N—N, located just outward from the side edge of the first cover member 2. The flexible cable 71 is connected to the parts of the portions 84, which are extended outward from the side edge of the first cover member 2. Therefore, the flexible cable 71 may be soldered to the strip-like conductive substrates 82 without overheating the actuator unit 1.

Figure 23:
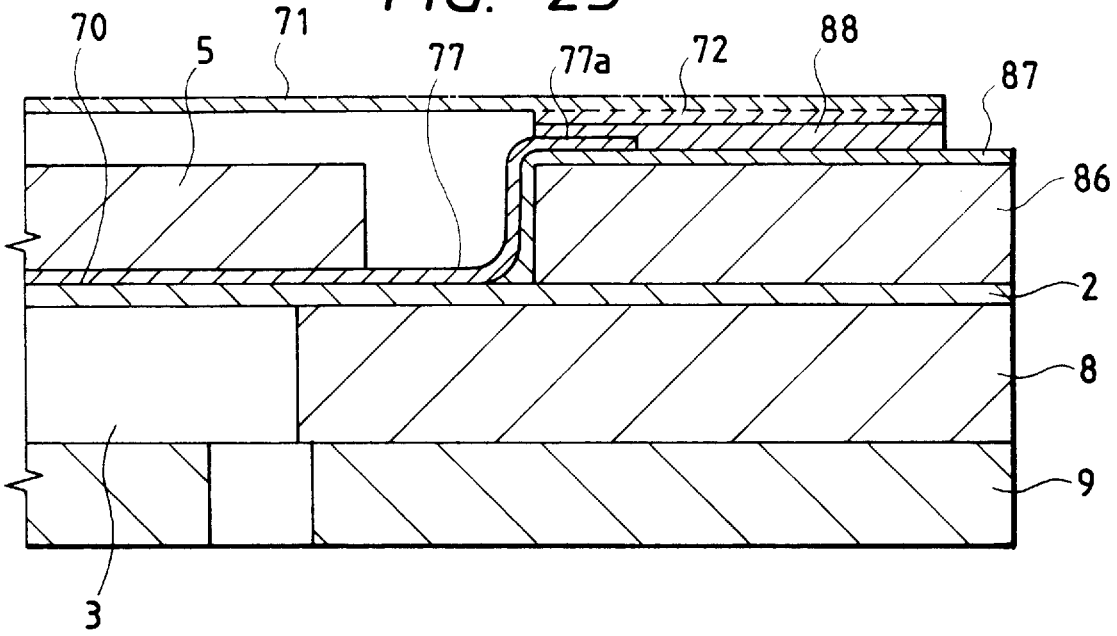
FIG. 23 is a sectional view showing yet another connection structure of a flexible cable to the discrete electrodes according to the invention.

FIG. 23 shows another embodiment of an ink jet print head according to the invention. A substrate 86, made of metal, serving also as a reinforcing substrate, is fastened to the first cover member 2 by adhesive. An insulating layer 87 is formed on the surface of the substrate 86. In the process of forming the discrete electrodes 70 and 70', lead portions 77, 77' are formed reaching the upper surface of the insulating layer 87. Further, junction parts 88, 88', suitable for the soldering connection, are formed covering the extreme parts 77*a*, 77*a'* of the lead portions 77, 77'.

Figure 24:
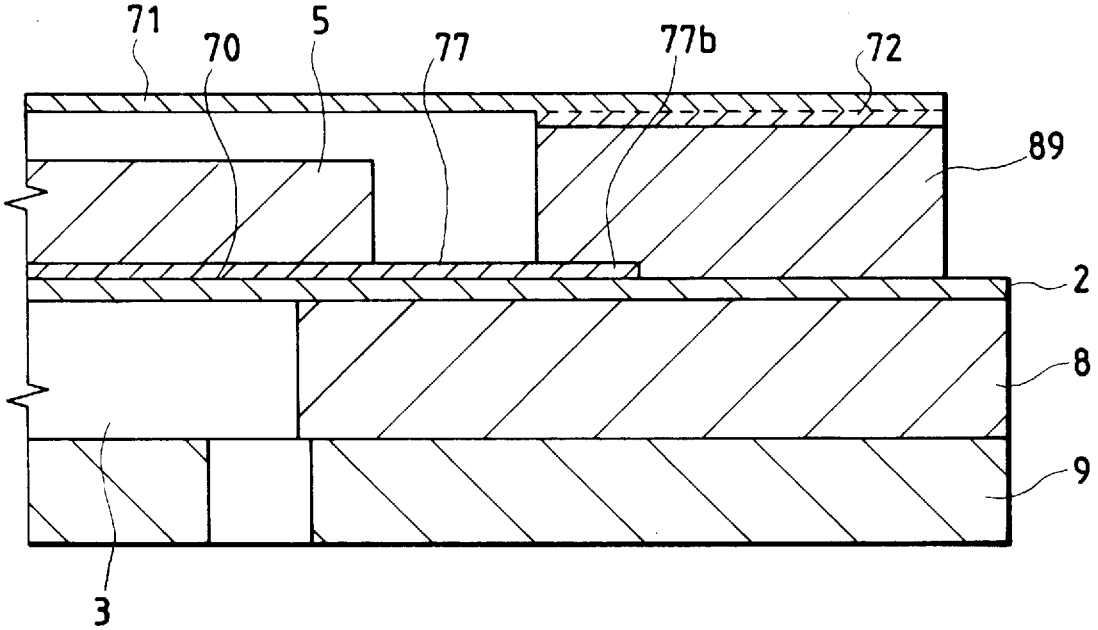
FIG. 24 is a sectional view showing a further connection structure of a flexible cable to the discrete electrodes according to the invention.

FIG. 24 shows yet another embodiment of an ink jet print head according to the invention.

In the embodiment, the extreme parts 77*b*, 77*b'* of the lead portions 77, 77' connecting to the discrete electrodes 70, 70' extend to the terminals 89, 89'. The terminals 89, 89' are formed, by a thick film printing method, on the discrete junction areas on the first cover member 2, which include the extreme parts 77*b*, 77*b'* and are arrayed at the same pitches as of the discrete electrodes and along the side edge of the actuator unit. The resultant terminals 89, 89' are higher than the piezoelectric vibrators 5, 5'. After the resultant structure is dried, the terminals 89, 89' are jointed to the flexible cable 71.

Figure 25:
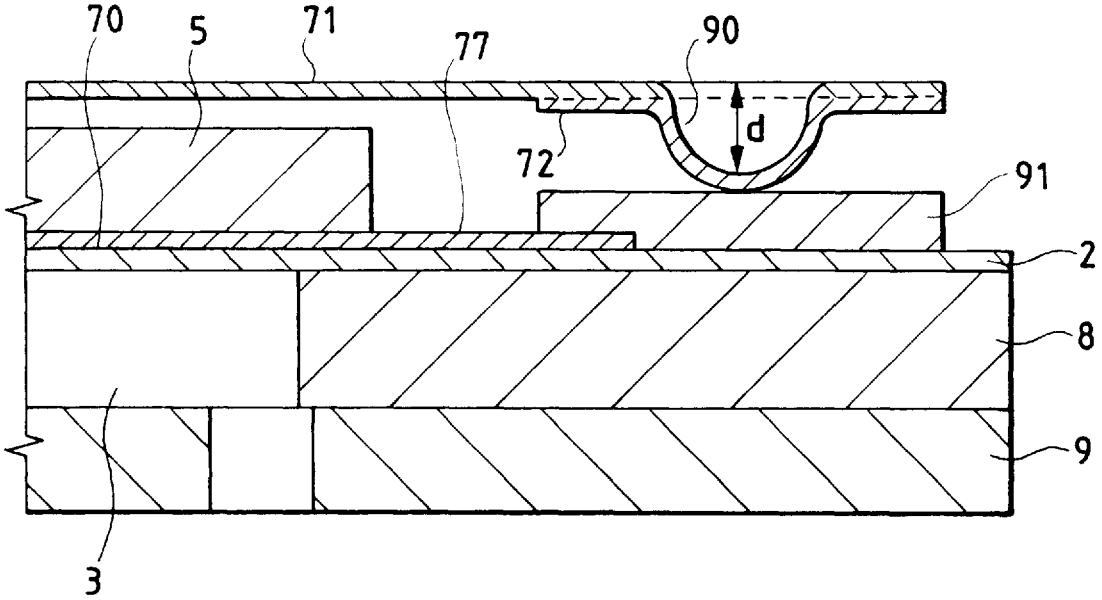
FIG. 25 is a sectional view showing another connection structure of a flexible cable to the discrete electrodes according to the invention.

Thus, in this embodiment, the upper surfaces of the terminals 89, 89' are higher than the piezoelectric vibrators 5, 5'. Another connection structure is illustrated in FIG. 25. As shown, spherical parts 90, 90', which are protruded toward the first cover member 2, are formed in the junction areas of the flexible cable 71. The depth d of the spherical parts 90, 90' is larger than the thickness of the piezoelectric vibrators 5, 5'. With the connection structure, the thickness of terminals 91, 91' may be reduced. The use of the thin terminals 91, 91' is advantageous when terminals 91, 91' are made of conductive adhesive since the time for drying the terminals 91, 91' is reduced.

Figure 26:
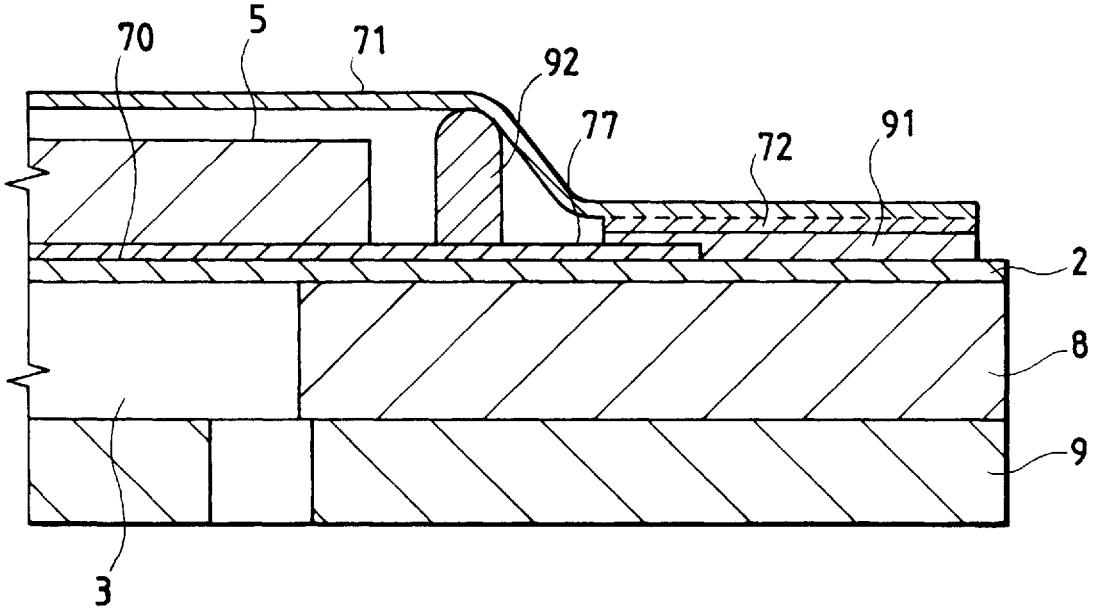
FIG. 26 is a sectional view showing still another connection structure of a flexible cable to the discrete electrodes according to the invention.
Figure 27:
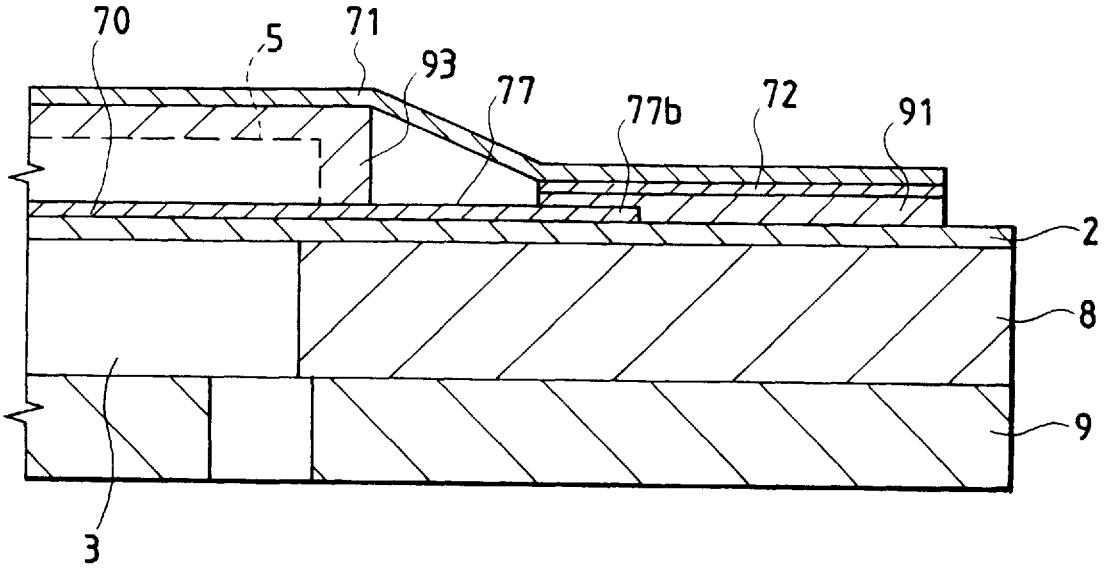
FIG. 27 is a sectional view showing an additional connection structure of a flexible cable to the discrete electrodes according to the invention.

FIGS. 26 and 27 show additional embodiments of an ink jet print head according to the invention. Supports 92 or 93 that are higher than the piezoelectric vibrators 5, 5' are provided in the portions of the actuator unit where neither of the piezoelectric vibrators 5 and 5' is present, for example, the portions close to the side ends of the actuator unit as shown in FIG. 23 or both ends of the piezoelectric vibrators 5 and 5' when viewed in the arrays thereof. Those supports 92 or 93 are disposed on the outer sides of the arrays of the piezoelectric vibrators 5 and 5', respectively. The flexible cable 71 is supported by the supports 92 or 93.

In the present embodiments, the supports 92 and 93 are merely added to the structure of the previous embodiment. Accordingly, a conventional manufacturing method may be applied to the manufacturing of the print head of the present embodiments.

Figure 28:
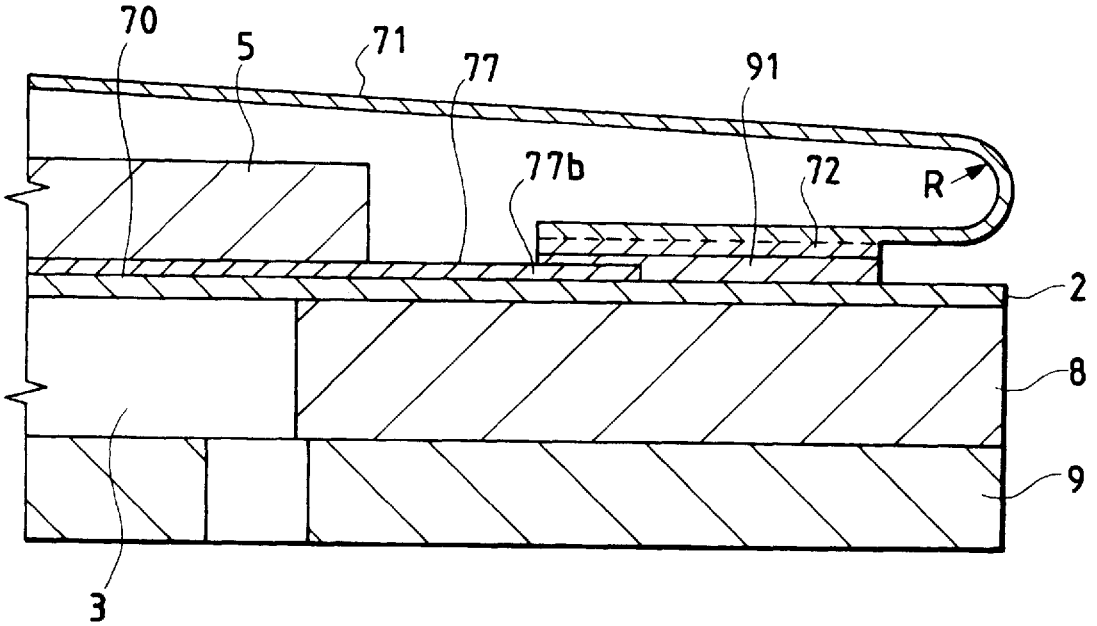
FIG. 28 is a sectional view showing a further connection structure of a flexible cable to the discrete electrodes according to the invention.

FIG. 28 shows an additional embodiment of an ink jet print head according to the invention. As shown, both ends of the flexible cable 71 are not buckled but bent at an appropriate radius R of curvature, whereby an elasticity of the heat resistant insulating film of the flexible cable 71 is actively used.

In this embodiment, the portion of the flexible cable 71 extending inward of the junction parts thereof is lifted up by the elasticity of the cable per se. Accordingly, the flexible cable 71 will never be in contact with the piezoelectric vibrators 5 and 5' unless a great force is applied to the cable.

In the above-mentioned embodiment, the discrete electrodes 70 and 70' are formed on the surface of the first cover member 2. Also in an ink jet print head of the type in which the discrete electrodes are formed on the surfaces of the piezoelectric vibrators 5 and 5' and the common electrode 4 is formed on the surface of the first cover member, the above-mentioned method is available if the discrete electrodes can be led to the side ends of the first cover member by the lead portions.

Pressure generating means, which are thin or low in height, are formed by sticking the thin plates made of piezoelectric material, e.g., PZT, to the electrode. Another type of the pressure generating means in which the first cover member is thinned or which may be formed within the pressure generating chamber may be used in place of the above-mentioned one.

Figure 29:
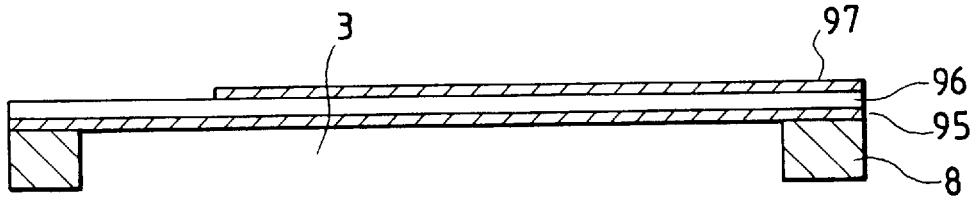
FIG. 29 is a sectional view showing a structure of the pressure generating means according to the present invention.

In a structure of the pressure generating means shown in FIG. 29, the first cover member 2, which seals the pressure generating chambers 3, 3', comprises a single piezoelectric vibrating layer 96 having a common electrode 95 formed on the lower surface thereof. Discrete electrodes 97 are formed in a regional area of the upper surface which faces the pressure generating chamber 4. Only the area of the piezoelectric vibrating layer 96 which faces the pressure chamber 3 is selectively flexible.

The piezoelectric vibrating layer 96 may be formed in a various ways. For example, it may be a thin plate as a piezoelectric vibrating plate. A layer of piezoelectric material is formed on the common electrode 95 by a sputtering method, a water-heat composing method or a hydrothermal method.

Figure 30:
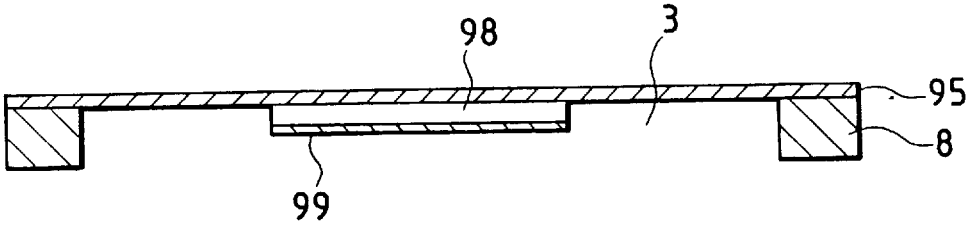
FIG. 30 is a sectional view showing another structure of the pressure generating means according to the present invention.

In a structure of the pressure generating means shown in FIG. 30, the first cover member 2 comprises a common electrode 95. Piezoelectric vibrators 98 and discrete electrodes 99 are formed on the lower surface of the common electrode 95, which faces the pressure generating chamber 3. If required, an elastic layer, for example, a thin plate of zirconia, for example, may be formed on the upper surface of the common electrode 95.

Figure 31:
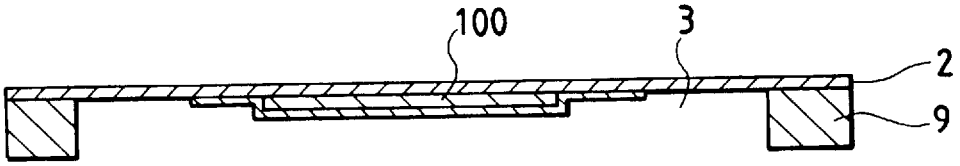
FIG. 31 is a sectional view showing still another structure of the pressure generating means according to the present invention.

In a structure of the pressure generating means shown in FIG. 31, a Joule heat generating element 100 is provided on the under surface of the cover member 2 for sealing the spacer 8, which faces the pressure generating chamber 3 or the surface of another member for defining the pressure generating chamber, which faces the pressure generating chamber. In this example, the Joule heat generating element 100 generates heat in accordance with controlled electrical signals applied thereto. With the generated heat, ink within the pressure generating chamber is vaporized to generate a pressure therein.

As seen from the foregoing description, an ink jet print head of the present invention has a first cover member, a spacer being sealed at one side by the first cover member to partially define pressure generating chambers communicatively coupled with nozzle openings, a member with nozzle openings for sealing the other side of the spacer, and pressure generating means for applying pressure to the pressure generating chambers. The print head is improved by first terminals being formed at the side ends of the first cover member and connected to discrete electrodes for selectively applying signals to the pressure generating means, and drive signal generating means for generating a drive signal to drive the pressure generating means in response to an external signal received, the drive signal generating means having second terminals arrayed at the same pitches as of the first terminals, and further the first terminals are directly connected to the second terminals of the pressure generating means in a state that a gap is present between the drive signal generating means and the pressure generating means.

In the print head thus arranged, the first cover member and the drive signal generating means are vertically arrayed.

Accordingly, any additional area is not required for providing the drive signal generating means. Further, the terminals are directly connected to the terminals of the drive signal generating means. Accordingly, there is eliminated the connection and soldering work using wires.

Further, in the present invention, the surfaces of the terminals, which are located at the side ends of the cover member, and are connected to the discrete electrodes for selectively applying signals to the piezoelectric vibrators, are higher than the pressure generating means. Accordingly, a gap may be formed between the pressure generating means and the flexible cable. Accordingly, the flexible cable will not come into contact with the piezoelectric vibrators. The resultant print head is free from the unwanted vibration of the cover member and the damage of the pressure generating means.

What is claimed is:

1. An ink jet print head comprising:

a cover member;

a spacer having a first side and a second side opposite said first side, said first side being attached to said cover to seal said first side and thereby partially define pressure generating chambers;

a member having nozzle openings for sealing the second side of said spacer, said nozzle opening being communicated with respective pressure generating chambers;

pressure generating means for applying pressure to said pressure generating chambers;

first terminals, arranged at a first pitch with respect to one another, and formed adjacent said cover member, for selectively applying signals to said pressure generating means;

discrete electrodes connected to said first terminals and said pressure generating means; and drive signal generating means for generating a drive signal to drive said pressure generating means in response to an external signal received, said drive signal generating means having second terminals arrayed at said first pitch so as to correspond to respective ones of said first terminals, wherein said first terminals are directly connected to said respective second terminals of said drive signal generating means in a state that a gap is present between said drive signal generating means and said pressure generating means.

2. The ink jet print head according to claim 1, wherein said drive signal generating means comprises a semiconductor chip, and said second terminals are directly formed on said semiconductor chip.

3. The ink jet print head according to claim 2, further comprising:

a support member connected between said semiconductor chip and said cover member thereby supporting said semiconductor chip, said support member being located at a location which does not interrupt vibration of said cover member.

4. The ink jet print head according to claim 1, wherein said drive signal generating means comprises a semiconductor chip and a mounting substrate on which said semiconductor chip is secured, and said second terminals are formed on said mounting substrate.

5. The ink jet print head according to claim 4, further comprising:

a support member connected between said mounting substrate and said cover member thereby supporting said mounting substrate, said support member being located at a location which does not interrupt vibration of said cover member.

6. The ink jet print head according to claim 4, in which said drive signal generating means comprising a semiconductor chip and a case in which said semiconductor chip is contained.

7. The ink jet print head according to claim 6, further comprising:

a support member connected between said case and said cover member thereby supporting said case, said support member being located at a location which does not interrupt vibration of said cover member.

8. The ink jet print head according to claim 4, wherein said mounting substrate is a flexible cable connecting to an external device.

9. The ink jet print head according to claim 8, further comprising:

a support member connected between said flexible cable and said cover member thereby supporting said flexible cable, said support member being located at a location which does not interrupt vibration of said cover member.

10. The ink jet print head according to claim 1, wherein either of said first and second terminals are made of thermally welding conductive material.

11. The ink jet print head according to claim 1, wherein either of said first and second terminals are made of conductive adhesive.

12. The ink jet print head according to claim 1, wherein said pressure generating means defines the outer periphery of a selected area on said cover member, and further comprising:

a support member, contacting said cover member within the periphery of said selected area, and supporting said drive signal generating means.

13. An ink jet print head comprising:

a cover member;

a spacer having a first side and a second side opposite said first side, said first side being attached to said cover to seal said first side and thereby partially define pressure generating chambers;

a member having nozzle openings for sealing the second side of said spacer, said nozzle openings being communicated with respective pressure generating chambers;

pressure generating means for applying pressure to said pressure generating chambers;

first terminals formed adjacent said cover member for selectively applying signals to said pressure generating means;

discrete electrodes connected to said first terminals and said pressure generating means;

a semiconductor integrated circuit for generating a drive signal to drive said pressure generating means in response to an external signal received, said semiconductor integrated circuit having a terminal portion for supplying drive signals;

a flexible cable comprising a heat resistant insulating film, a solderable metal foil layered on said heat resistant insulating film, a window located at a place facing said pressure generating chambers and provided for fastening to said semiconductor integrated circuit, and connecting means for electrically connecting said flexible cable with said semiconductor integrated circuit; and a support member connected between said semiconductor integrated circuit and said cover member, thereby supporting said semiconductor integrated circuit, said support being located at a location which does not interrupt vibration of said cover member.

14. The print head according to claim 13, wherein said semiconductor has a fringe, and at least said fringe of said semiconductor integrated circuit is molded together with said flexible cable with high polymer.

15. The ink jet print head according to claim 13, wherein said pressure generating means defines the outer periphery of a selected area on said cover member, and further comprising:

a support member, contacting said cover member within the periphery of said selected area, and supporting said semiconductor integrated circuit.

16. An ink jet print head comprising:

a cover member;

a spacer having a first side and a second side opposite said first side, said first side being attached to said cover to seal said first side and thereby partially define pressure generating chambers;

a member having nozzle openings for sealing the second side of said spacer, said nozzle openings being communicated with respective pressure generating chambers;

pressure generating means for applying pressure to said pressure generating chambers, said pressure generating means including a thickness;

terminals formed on said cover member for selectively applying signals to said pressure generating means, said terminals having a thickness greater than that of said pressure generating means;

discrete electrodes being arranged at a first pitch and electrically connected to said terminals and said pressure generating means; and a flexible cable for transferring electrical signals, said flexible cable being extended over said pressure generating means and secured at both ends thereof to said terminals.

17. The ink jet print head according to claim 16, wherein said terminals are each formed of electrically insulating members covered with conductive films.

18. The ink jet print head according to claim 17 or 16, wherein said insulating material of said terminals is the same as that of said pressure generating means.

19. The ink jet print head according to claim 16, wherein said terminals comprise discrete conductive films that are arrayed at said first pitch on an elongated plate of electrically insulating material extending over lead portions which extend from the discrete electrodes.

20. The ink jet print head according to claim 19, wherein said terminals comprise discrete conductive films layered on strips of electrically insulating material substantially equal in width to the discrete electrodes.

21. The ink jet print head according to claim 16, wherein said terminals comprise discrete conductive strips substantially equal in width to the discrete electrodes.

22. The ink jet print head according to claim 21, wherein said conductive material includes conductive adhesive.

23. The ink jet print head according to claim 16, wherein said terminals have a metal layer, suitable for soldering connection, formed thereon.

24. The ink jet print head according to claim 16, wherein said terminals comprise: elongated conductive plates; electrically insulating layers being formed on said elongated conductive plates; and conductive junction parts being formed thereon at said first pitch so as to correspond to locations of said discrete electrodes.

25. An ink jet print head comprising:

a cover member;

a spacer having a first side and a second side opposite said first side, said first side being attached to said cover to seal said first side to thereby partially define pressure generating chambers;

a member having nozzle openings for sealing the second side of said spacer, said nozzle openings being communicated with respective pressure generating chambers;

pressure generating means for applying pressure to said pressure generating chambers;

spherical parts formed at junction areas of a flexible cable for supplying a signal external of said print head to said pressure generating means, said flexible cable being mounted adjacent said cover member, and wherein a depth of each said spherical parts is selected to such an extent as to allow an underside of said flexible cable to retract to a place where the flexible cable does not interrupt vibration of said cover member.

26. An ink jet print head comprising:

a cover member;

a spacer having a first side and a second opposite said first side, said first side being attached to said cover to seal said first side and thereby partially define pressure generating chambers;

a member having nozzle openings for sealing the second side of said spacer, said nozzle openings being communicated with respective pressure generating chambers;

pressure generating means for applying pressure to said pressure generating chambers, said pressure generating means defining the outer periphery of a selected area on said cover member;

a support member, contacting said cover member within the periphery of said selected area, and supporting a flexible cable for supplying an external signal to said print head such that the flexible cable is placed at a location on said cover member such that vibration of said cover member is not interrupted.

27. An ink jet print head comprising:

a cover member;

a spacer having a first side and a second side opposite said first side, said first side being attached to said cover to seal said first side and thereby partially define pressure generating chambers;

a member having nozzle openings for sealing the second side of said spacer, said nozzle openings being communicated with respective pressure generating chambers;

pressure generating means for applying pressure to said pressure generating chambers; and a flexible cable, having a central portion and junction areas connected to said pressure generating means, for transferring an external signal, wherein regions of said flexible cable near the junction areas are bent at an appropriate radius of curvature such that a central portion of said flexible cable is lifted up by elasticity of the flexible cable.

* * * * *